US010544477B2

(12) United States Patent
Kimura et al.

(10) Patent No.: US 10,544,477 B2
(45) Date of Patent: Jan. 28, 2020

(54) METHOD FOR MANUFACTURING HIGH-STRENGTH GALVANIZED STEEL SHEET

(71) Applicant: JFE STEEL CORPORATION, Tokyo (JP)

(72) Inventors: Hideyuki Kimura, Fukuyama (JP); Koichiro Fujita, Nagoya (JP); Hiroshi Hasegawa, Fukuyama (JP); Mai Aoyama, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 378 days.

(21) Appl. No.: 15/327,489

(22) PCT Filed: Jun. 9, 2015

(86) PCT No.: PCT/JP2015/002876

§ 371 (c)(1),
(2) Date: Jan. 19, 2017

(87) PCT Pub. No.: WO2016/013144

PCT Pub. Date: Jan. 28, 2016

(65) Prior Publication Data

US 2017/0152580 A1 Jun. 1, 2017

(30) Foreign Application Priority Data

Jul. 25, 2014 (JP) ..... 2014-152096

(51) Int. Cl.

| | |
|---|---|
| ***C21D 9/46*** | (2006.01) |
| ***B21B 1/26*** | (2006.01) |
| ***B21B 3/00*** | (2006.01) |
| ***C23C 2/06*** | (2006.01) |
| ***C23C 2/40*** | (2006.01) |
| ***C22C 38/14*** | (2006.01) |
| ***C21D 8/02*** | (2006.01) |
| ***C22C 38/00*** | (2006.01) |
| ***C22C 38/02*** | (2006.01) |

(Continued)

(52) U.S. Cl.

CPC ..... *C21D 9/46* (2013.01); *B21B 1/26* (2013.01); *B21B 3/00* (2013.01); *C21D 8/0226* (2013.01); *C21D 8/0236* (2013.01); *C21D 8/0263* (2013.01); *C21D 8/0278* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/24* (2013.01); *C22C 38/26* (2013.01); *C22C 38/28* (2013.01); *C22C 38/38* (2013.01); *C23C 2/06* (2013.01); *C23C 2/40* (2013.01); *C23G 1/081* (2013.01); *C23G 1/085* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 9/46; C21D 2211/008; C21D 2211/002; C21D 2211/005; C21D 2211/001; C21D 8/0226; C21D 8/0236; C21D 8/0263; C21D 8/0278; C23G 1/081; C23G 1/085; B21B 1/26; B21B 1/28; B21B 3/00; C23C 2/02; C23C 2/06; C23C 2/40; C23C 2/28; C22C 18/00; C22C 38/02; C22C 38/26; C22C 38/28; C22C 38/38; C22C 38/06; C22C 38/12; C22C 38/04; C22C 38/001; C22C 38/002; C22C 38/24; C22C 38/58; C22C 38/14; C22C 38/00

See application file for complete search history.

(56) References Cited

U.S. PATENT DOCUMENTS

| | | | |
|---|---|---|---|
| 6,410,163 B1 | 6/2002 | Suzuki et al. | |
| 6,558,815 B1 * | 5/2003 | Suzuki | C22C 23/02 148/533 |

(Continued)

FOREIGN PATENT DOCUMENTS

| | | |
|---|---|---|
| CN | 101641456 A | 2/2010 |
| CN | 101657558 A | 2/2010 |

(Continued)

OTHER PUBLICATIONS

International Search Report and Written Opinion for International Application No. PCT/JP2015/002876, dated Sep. 15, 2015, 7 pages.

(Continued)

*Primary Examiner* — Keith Walker
*Assistant Examiner* — John A Hevey
(74) *Attorney, Agent, or Firm* — RatnerPrestia

(57) ABSTRACT

A method for manufacturing a high-strength galvanized steel sheet includes performing hot rolling, cold rolling, first annealing, pickling, and second annealing. The first annealing is performed to obtain a steel sheet having a steel microstructure including ferrite in an amount of 10% or more and 60% or less in terms of area ratio, and martensite, bainite, and retained austenite in a total amount of 40% or more and 90% or less in terms of area ratio. The second annealing includes heating to an annealing temperature of 750° C. or higher and 850° C. or lower, holding at the annealing temperature for 10 seconds or more and 500 seconds or less, cooling at an average cooling rate of 1° C./s or more and 15° C./s or less, performing a galvanizing treatment, and cooling to a temperature of 150° C. or lower at an average cooling rate of 5° C./s or more and 100° C./s or less.

12 Claims, No Drawings

(51) Int. Cl.

| | |
|---|---|
| ***C22C 38/04*** | (2006.01) |
| ***C22C 38/06*** | (2006.01) |
| ***C22C 38/12*** | (2006.01) |
| ***C22C 38/24*** | (2006.01) |
| ***C22C 38/26*** | (2006.01) |
| ***C22C 38/28*** | (2006.01) |
| ***C22C 38/38*** | (2006.01) |
| ***C23G 1/08*** | (2006.01) |

(56) References Cited

U.S. PATENT DOCUMENTS

| | | | | |
|---|---|---|---|---|
| 2003/0054195 | A1* | 3/2003 | Ishii | C21D 8/0278 428/653 |
| 2003/0106620 | A1* | 6/2003 | Nagataki | C21D 8/0205 148/533 |
| 2004/0055667 | A1 | 3/2004 | Takada | |
| 2013/0071687 | A1* | 3/2013 | Takagi | C21D 8/0226 428/659 |
| 2015/0017472 | A1 | 1/2015 | Kimura | |

FOREIGN PATENT DOCUMENTS

| | | | |
|---|---|---|---|
| CN | 101688277 | A | 3/2010 |
| CN | 102414335 | A | 4/2012 |
| CN | 103140594 | A | 6/2013 |
| EP | 2128295 | A1 | 12/2009 |
| EP | 2138599 | A1 | 12/2009 |
| EP | 2184374 | A1 | 5/2010 |
| EP | 2426230 | A1 | 3/2012 |
| EP | 2623622 | A1 | 8/2013 |
| EP | 3138931 | A | 3/2017 |
| JP | 04202630 | | 7/1992 |
| JP | 2000290730 | | 10/2000 |
| JP | 2002294397 | | 10/2002 |
| JP | 2004263271 | | 9/2004 |
| JP | 2007302918 | A | 11/2007 |
| JP | 2009035818 | A | 2/2009 |
| JP | 2012012703 | | 1/2012 |
| JP | 2013076148 | A | 4/2013 |
| JP | 2013177673 | | 9/2013 |
| JP | 2013221198 | | 10/2013 |
| JP | 2015117403 | | 6/2015 |

OTHER PUBLICATIONS

Chinese Office Action for Chinese Application No. 2015801040, dated Oct. 30, 2017, including Concise Statement of Search Report, 11 pages.

Supplementary European Search Report for Application No. EP 15824203.2, dated Jun. 20, 2017, 9 pages.

* cited by examiner

METHOD FOR MANUFACTURING HIGH-STRENGTH GALVANIZED STEEL SHEET

CROSS REFERENCE TO RELATED APPLICATIONS

This is the U.S. National Phase application of PCT International Application No. PCT/JP2015/002876, filed Jun. 9, 2015 and claims priority to Japanese Patent Application No. 2014-152096, filed Jul. 25, 2014, the disclosures of these applications being incorporated herein by reference in their entireties for all purposes.

FIELD OF THE INVENTION

The present invention relates to a method for manufacturing a galvanized steel sheet, in particular, to a method for manufacturing a high-strength galvanized steel sheet which can preferably be used for automobile parts, which is excellent in terms of coated-surface appearance quality, and whose mechanical properties have small annealing-temperature dependency.

BACKGROUND OF THE INVENTION

Nowadays, there is a demand for improving the fuel efficiency of automobiles in order to control $CO_2$ emission from the viewpoint of the global environment conservation. In addition, there is a demand for improving the safety of automobiles including the crashworthiness of the automobiles in order to achieve satisfactory occupant safety at the time of a crash. Therefore, there is an active trend toward decreasing the weight of automobiles and increasing the strength of automobiles.

It is considered that decreasing the weight of automobiles through a decrease in the thicknesses of materials for parts within a range in which there is no problem regarding rigidity as a result of increasing the strength of the materials for parts is effective in order to realize a decrease in the weight of automobiles and an increase in the strength of automobiles at the same time. Nowadays, there is an active trend toward using a high-strength steel sheet for automobile parts so that the tensile strength (TS) of steel sheets which are used for the structural members and stiffening members of automobiles reaches 980 MPa or more, and a steel sheet having a TS of 1180 MPa or more is also used. The utilization of microstructure strengthening is effective for increasing the strength of a steel sheet. In particular, a multi-phase steel sheet composed of soft ferrite and hard martensite generally has good ductility and an excellent strength-ductility balance and is a kind of strengthened steel sheet having a comparatively good press formability. However, in the case of such a multi-phase steel sheet, since the mechanical properties of the steel sheet such as tensile strength (TS) widely vary due to a variation in conditions such as annealing temperature which occurs when the multi-phase steel sheet is manufactured by using an ordinary continuous annealing line, the mechanical properties tend to vary in the longitudinal direction of a coil, that is, in the longitudinal direction of the steel sheet wound in a coil shape. Since it is difficult to stably perform press forming in a continuous pressing line for automobiles due to such deviation of mechanical properties, there is a risk of a significant decrease in usability. In addition, when the strength of a steel sheet is increased, there are an increase in the content of Si, which is a solid solution chemical element effective for increasing strength and an increase in the contents of, for example, C and Mn, which are added to achieve a necessary amount of martensite in order to increase strength. Since Si and Mn are easily oxidizable chemical elements which are more readily oxidized than Fe, achieving satisfactory zinc coatability and surface appearance quality is an issue in the case where a galvanizing treatment is performed on a steel sheet containing large amounts of Si and Mn. That is, since Si and Mn contained in steel are subjected to selective oxidation even in a non-oxidizing atmosphere or a reducing atmosphere used in a general annealing furnace, Si and Mn are concentrated and form oxides on the surface of the steel, which may cause a coating defect occurring due to a decrease in the wettability of molten zinc to a steel sheet when a galvanizing treatment is performed.

Patent Literature 1 proposes a method for improving the wettability with molten zinc in order to improve the adhesiveness of a galvanizing layer in which an Fe oxide film is formed rapidly on the surface at an oxidation speed higher than a specified speed by heating a steel sheet in an oxidizing atmosphere in advance in order to prevent the oxidation of additive chemical elements such as Si and Mn on the surface of the steel sheet and in which the Fe oxide film is then reduced by performing annealing in a specified atmosphere. In addition, Patent Literature 2 proposes a method in which the surface-concentration matter of easily oxidizable chemical elements such as Si and Mn, which are concentrated on the surface of a steel sheet, is removed by performing pickling on the steel sheet after annealing has been performed, in which annealing is then performed again, and in which a galvanizing treatment is then performed.

CITATION LIST

Patent Literature

PTL 1: Japanese Unexamined Patent Application Publication No. 4-202630

PTL 2: Japanese Unexamined Patent Application Publication No. 2000-290730

SUMMARY OF THE INVENTION

However, in the case of the technique according to Patent Literature 1, there may be a problem in that a pressing flaw occurs in a steel sheet due to oxidized iron sticking to rolls in a furnace in the case where the amount of oxidation of the steel sheet is large. In addition, in Patent Literature 2, although there is mention of a steel sheet having a strength of 590 MPa grade, there is no mention of a high-strength steel sheet having a TS of 780 MPa or more, and there is no mention of an elongation property, which can be used as an index of press formability, or the deviation of mechanical properties.

In addition, since a high-strength steel sheet contains various alloy chemical elements in large amounts in order to increase strength, the amount of martensite in the steel sheet, for example, varies due to a variation in annealing conditions which occurs in an ordinary continuous annealing line. Therefore, the deviation of mechanical properties such as strength and elongation tends to increase in a coil, that is, in the steel sheet wound in a coil shape, in particular, in the longitudinal direction of the coil. In the case where the deviation of mechanical properties is large, it is difficult to stably perform press forming in a continuous pressing line for automobiles, which causes a significant decrease in usability. Therefore, in order to improve the homogeneity of mechanical properties in the longitudinal direction of a coil, there is a desire for a method for manufacturing a galvanized steel sheet whose deviation of mechanical properties is small even in the case where annealing conditions vary, that is, whose mechanical properties have small annealing-temperature dependency.

Aspects of the present invention have been completed in view of the situation described above, and an object of aspects of the present invention is to provide a method for manufacturing a galvanized steel sheet which is excellent in terms of coated-surface appearance quality and whose mechanical properties have small annealing-temperature dependency by using steel containing C, Si, Mn and so forth, which are necessary to achieve a high strength corresponding to a TS of 1180 MPa or more.

The present inventors, in order to develop a high-strength steel sheet to be used for the structural members of automobiles, diligently conducted investigations regarding various factors influencing an increase in strength, the annealing-temperature dependency of mechanical properties, and a coated-surface appearance quality in the case of various steel sheets. As a result, the present inventors found that it is possible to manufacture a high-strength galvanized steel sheet which has a steel microstructure including, in terms of area ratio, 10% or more and 60% or less of ferrite and, in terms of area ratio, 40% or more and 90% or less of martensite, which is excellent in terms of surface appearance quality, and whose mechanical properties have small annealing-temperature dependency by performing hot rolling on a steel slab having a chemical composition containing, by mass %, C:0.120% or more and 0.180% or less, Si:0.01% or more and 1.00% or less, and Mn:2.20% or more and 3.50% or less in order to obtain a hot-rolled steel sheet, by performing cold rolling on the hot-rolled steel sheet in order to obtain a cold-rolled steel sheet, by then performing first annealing on the cold-rolled steel sheet, by performing pickling on the annealed steel sheet, and by then performing second annealing on the pickled steel sheet in order to obtain a galvanized steel sheet, in which the first annealing is performed under specified heat treatment conditions in order to form the steel microstructure of the steel sheet including a ferrite phase in an amount of, in terms of area ratio, 10% or more and 60% or less, and martensite, bainite, and retained austenite in a total amount of 40% or more and 90% or less in terms of area ratio, after the first annealing has been performed, and in which the second annealing including a galvanizing treatment is further performed under specified conditions.

Aspects of the present invention have been completed on the basis of the knowledge described above, and a summary of aspects of the present invention is as follows.

[1] A method for manufacturing a high-strength galvanized steel sheet, the method including performing hot rolling on a steel slab having a chemical composition containing, by mass %, C:0.120% or more and 0.180% or less, Si:0.01% or more and 1.00% or less, Mn:2.20% or more and 3.50% or less, P:0.001% or more and 0.050% or less, S:0.010% or less, sol.Al:0.005% or more and 0.100% or less, N:0.0001% or more and 0.0060% or less, Nb:0.010% or more and 0.100% or less, Ti:0.010% or more and 0.100% or less, and the balance being Fe and inevitable impurities in order to obtain a hot-rolled steel sheet, performing cold rolling on the hot-rolled steel sheet in order to obtain a cold-rolled steel sheet, then performing first annealing on the cold-rolled steel sheet, performing pickling on the annealed steel sheet, and then performing second annealing on the pickled steel sheet in order to obtain a galvanized steel sheet, in which the first annealing includes performing heating to an annealing temperature of 780° C. or higher and 850° C. or lower at an average heating rate of 1° C./s or less in a temperature range from 700° C. to the annealing temperature, holding the heated steel sheet at an annealing temperature of 780° C. or higher and 850° C. or lower for 10 seconds or more and 500 seconds or less, and cooling the held steel sheet from the annealing temperature to a cooling stop temperature of 500° C. or lower at an average cooling rate of 5° C./s or more in order to obtain a steel sheet having a steel microstructure including ferrite in an amount of 10% or more and 60% or less in terms of area ratio, and martensite, bainite, and retained austenite in a total amount of 40% or more and 90% or less in terms of area ratio, in which the pickling is performed so that the amount of decrease in the weight of the steel sheet due to pickling is 0.05 g/m$^2$ or more and 5 g/m$^2$ or less in terms of Fe, and in which the second annealing includes heating the pickled steel sheet to an annealing temperature of 750° C. or higher and 850° C. or lower, holding the heated steel sheet at an annealing temperature of 750° C. or higher and 850° C. or lower for 10 seconds or more and 500 seconds or less, cooling the held steel sheet from the annealing temperature at an average cooling rate of 1° C./s or more and 15° C./s or less, performing a galvanizing treatment including dipping the steel sheet in a galvanizing bath, cooling the galvanized steel sheet to a temperature of 150° C. or lower at an average cooling rate of 5° C./s or more and 100° C./s or less in order to obtain a steel sheet having a steel microstructure including, in terms of area ratio, 10% or more and 60% or less of ferrite and, in terms of area ratio, 40% or more and 90% or less of martensite.

[2] The method for manufacturing a high-strength galvanized steel sheet according to item [1] above, in which an alloying treatment is further performed on the galvanized steel sheet before cooling is performed at an average cooling rate of 5° C./s or more and 100° C./s or less.

[3] The method for manufacturing a high-strength galvanized steel sheet according to item [1] or [2] above, in which the steel slab has the chemical composition further containing, by mass %, one or more selected from among Mo: 0.05% or more and 1.00% or less, V:0.02% or more and 0.50% or less, Cr:0.05% or more and 1.00% or less, and B:0.0001% or more and 0.0030% or less.

[4] The method for manufacturing a high-strength galvanized steel sheet according to any one of items [1] to [3] above, in which the hot rolling includes starting cooling within 3 seconds after hot finish rolling has been performed, cooling the hot-rolled steel sheet at an average cooling rate of 5° C./s or more and 200° C./s or less in a temperature range from the finishing delivery temperature of the hot rolling to a temperature of (the finishing delivery temperature of the hot rolling-100° C.), coiling the cooled steel sheet at a coiling temperature of 450° C. or higher and 650° C. or lower, and in which the cold rolling is performed with a rolling reduction of 40% or more.

Here, in accordance with aspects of the present invention, the meaning of the term "a galvanized steel sheet" includes a galvanized steel sheet, which is not subjected to an alloying treatment, and a galvannealed steel sheet, which is a galvanized steel sheet which has been subjected to an alloying treatment.

According to aspects of the present invention, it is possible to obtain a high-strength galvanized steel sheet which has a high strength corresponding to a tensile strength (TS) of 1180 MPa or more, which is excellent in terms of surface appearance quality, and whose mechanical properties have small annealing-temperature dependency. Therefore, in the case where the high-strength galvanized steel sheet according to aspects of the present invention is used for the skeleton members of automobiles, since it is possible to significantly contribute to an improvement in the crashworthiness of the automobiles and a decrease in the weight of the automobiles, and since the annealing-temperature dependency of mechanical properties is small, the homogeneity of mechanical properties in a coil is high, and an improvement in usability in a press forming process is also anticipated.

DETAILED DESCRIPTION OF EMBODIMENTS OF THE INVENTION

Hereafter, aspects of the present invention will be described in detail.

In order to obtain a high-strength steel sheet having a tensile strength (TS) of 1180 MPa or more, it is necessary to add, to a multi-phase steel sheet composed of ferrite and martensite, a large amount of Si, which is added in order to strengthen ferrite, and large amounts of C and Mn, which are added in order to increase the area ratio of martensite. However, since Si and Mn are easily oxidizable chemical elements, which are more readily oxidized than Fe, zinc coatability and surface appearance quality may be decreased in the case where a galvanized steel sheet containing Si and Mn in large amounts is manufactured. In addition, in the case of a high-strength multi-phase steel sheet having a TS of 1180 MPa or more, since the amount of martensite in the steel sheet, for example, tends to vary due to a variation in annealing conditions which occurs in an ordinary continuous annealing line, the deviation of mechanical properties such as strength and elongation tends to increase in a coil, in particular, in the longitudinal direction of the coil. In this case, it is difficult to stably perform press forming in a continuous pressing line for automobiles, which may cause a significant decrease in usability.

Therefore, the present inventors diligently conducted investigations, and, as a result, newly found that, it is possible to obtain a high-strength galvanized steel sheet which has a TS of 1180 MPa or more and whose mechanical properties have small annealing-temperature dependency by appropriately controlling a microstructure formed after first annealing has been performed, by pickling the annealed steel sheet, by performing second annealing on the pickled steel sheet, and by performing a galvanizing treatment in the second annealing process. In addition, by actively adding Nb and Ti, which raises the recrystallization temperature, and by appropriately controlling a heating rate in the first annealing process, the diffusion of Si and Mn in the first annealing process is promoted due to the strain effect of a non-recrystallized microstructure, and therefore it is possible to form a Si—Mn-depleted layer in the surface layer of the steel sheet while forming surface oxides. Accordingly, it was found that, by removing only the surface oxides in the pickling process after the first annealing has been performed, the surface concentration of Si and Mn in steel is inhibited from occurring again by the Si—Mn-depleted layer in the surface layer of the steel sheet in the subsequent second annealing process, and therefore it is possible to obtain a high-strength galvanized steel sheet excellent in terms of surface appearance quality. Moreover, it was found that, by controlling the recrystallization temperature through the addition of Nb and Ti and by controlling a heating rate in the first annealing process, there is a decrease in the grain diameter of hard phases mainly including ferrite and martensite due to the simultaneous development of recrystallization and α-γ transformation in the first annealing process, and therefore the fine microstructure is maintained even after the pickling and the second (final) annealing process, which results in an improvement in stretch flange formability, and aspects of the present invention were completed.

Hereafter, aspects of the present invention will be specifically described.

First, the chemical composition of steel according to aspects of the present invention will be described. Hereinafter, "%" related to a chemical composition shall refer to mass %.

C:0.120% or more and 0.180% or less

C is a chemical element which is effective for increasing the strength of a steel sheet, and C contributes to an increase in strength by forming martensite. Also, C contributes to an increase in strength by forming fine alloy compounds or alloy carbonitrides with carbide-forming chemical elements such as Nb and Ti. In order to realize such effects, it is necessary that the C content be 0.120% or more. On the other hand, in the case where the C content is more than 0.180%, there may be a decrease in weldability due to a decrease in the toughness of a weld zone formed by performing spot welding, and there is also a tendency for workability to significantly decrease due to an increase in the hardness of a steel sheet as a result of an increase in the amount of martensite. Therefore, the C content is set to be 0.180% or less. Therefore, the C content is set to be 0.120% or more and 0.180% or less, or preferably 0.120% or more and 0.150% or less.

Si:0.01% or more and 1.00% or less

Si is a chemical element which contributes to an increase in strength mainly through solid solution strengthening and which contributes to an improvement not only in strength but also in strength-ductility balance because a decrease in ductility due to an increase in strength is comparatively small. Also, since Si is effective for expanding a temperature range in which a dual phase is formed when annealing is performed, Si is effective for decreasing the annealing-temperature dependency of mechanical properties. In order to realize such effects, it is necessary that the Si content be 0.01% or more. On the other hand, in the case where the Si content is more than 1.00%, Si-based oxides tend to be formed on the surface of a steel sheet, which may result in a coating defect. Therefore, the Si content is set to be 1.00% or less. Therefore, the Si content is set to be 0.01% or more and 1.00% or less, or preferably 0.01% or more and 0.50% or less.

Mn:2.20% or more and 3.50% or less

Mn is a chemical element which contributes to an increase in strength through solid solution strengthening and by forming martensite, and it is necessary that the Mn content be 2.20% or more in order to realize such an effect. On the other hand, in the case where the Mn content is more than 3.50%, there is an increase in material costs, and, since a microstructure includes a portion having a transformation temperature different from that of the other portions due to, for example, the segregation of Mn, an inhomogeneous microstructure in which a ferrite phase and a martensite phase are formed in band shapes tends to be formed, which may result in a decrease in workability. In addition, Mn may be concentrated on the surface of a steel sheet in the form of oxides, which may result in a coating defect. Moreover, the toughness of a weld zone formed by performing spot welding may be decreased, which may decrease weldability. Therefore, the Mn content is set to be 3.50% or less. Therefore, the Mn content is set to be 2.20% or more and 3.50% or less. It is preferable that the Mn content be 2.50% or more in order to stably achieve a TS of 1180 MPa or more.

P:0.001% or more and 0.050% or less

P is a chemical element which is effective for increasing the strength of a steel sheet through solid solution strengthening. However, in the case where the P content is less than 0.001%, such an effect is not realized, and there may be an increase in dephosphorization costs in a steel making process. Accordingly, the P content is set to be 0.001% or more. On the other hand, in the case where the P content is more than 0.050%, there is a marked decrease in weldability. Therefore, the P content is set to be 0.050% or less. Therefore, the P content is set to be 0.001% or more and 0.050% or less, preferably 0.001% or more and 0.030% or less, or more preferably 0.001% or more and 0.020% or less.

S:0.010% or less

S is a harmful chemical element which causes hot brittleness and which decreases the workability of a steel sheet as a result of existing in the form of sulfide-based inclusions in steel. Therefore, it is preferable that the S content be as small as possible, and the upper limit of the S content is set to be 0.010% in accordance with aspects of the present invention, or preferably the S content is set to be 0.008% or less. Although there is no particular limitation on the lower limit of the S content, since there is an increase in refining costs in order to achieve ultralow S content, it is preferable that the S content be 0.0001% or more.

sol.Al:0.005% or more and 0.100% or less

Al is a chemical element which is added as a deoxidizing agent, and, since Al has a solid solution strengthening capability, Al is effective for increasing strength. However, in the case where the content of Al in the form of sol.Al is less than 0.005%, the effects described above are not realized. Therefore, the content of Al in the form of sol.Al is set to be 0.005% or more. On the other hand, in the case where the content of Al in the form of sol.Al is more than 0.100%, there is an increase in material costs, and surface defects of a steel sheet may occur. Therefore, the content of Al in the form of sol.Al is set to be 0.100% or less. Therefore, the content of Al in the form of sol.Al is set to be 0.005% or more and 0.100% or less.

N:0.0001% or more and 0.0060% or less

In the case where the N content is more than 0.0060%, since nitrides are formed in excessive amounts in steel, there may be a decrease in ductility and toughness, and there may be a decrease in the surface quality of a steel sheet. Therefore, the N content is set to be 0.0060% or less. On the other hand, although it is preferable that the N content be as small as possible in order to increase ductility by cleaning ferrite, the lower limit of the N content is set to be 0.0001% in order to prevent an increase in steel making costs. Therefore, the N content is set to be 0.0001% or more and 0.0060% or less.

Nb:0.010% or more and 0.100% or less

Nb contributes to an increase in strength by forming carbides and carbonitrides with C and N. In addition, since Nb has a function of decreasing the grain diameter of the microstructure of a hot-rolled steel sheet, and since Nb inhibits an increase in grain diameter in a recrystallization process, Nb contributes to an improvement in stretch flange formability and a decrease in the annealing-temperature dependency of mechanical properties by homogeneously decreasing the grain diameter of ferrite and martensite. Moreover, since Nb raises the recrystallization temperature, it is possible to maintain a non-recrystallized microstructure in a high temperature range in which Si and Mn easily diffuse. Therefore, by appropriately controlling a heating rate in the first annealing process, it is possible to form a Si—Mn-depleted layer in the surface layer of the steel sheet while forming the surface oxides of Si and Mn due to the effect of promoting diffusion by the strain of the non-recrystallized microstructure. Subsequently, by performing the second annealing after pickling, which follows the first annealing process, has been performed in order to remove the surface oxides of Si and Mn, there is an improvement in zinc coatability and surface appearance quality due to the effect of inhibiting the surface concentration of Si and Mn in steel from occurring again by the Si—Mn-depleted layer in the surface layer of the steel sheet. Moreover, by controlling the recrystallization temperature through the addition of Nb and by controlling a heating rate in the first annealing process, since there is a decrease in the grain diameter of hard phases mainly including ferrite and martensite due to the simultaneous development of recrystallization and $\alpha$-$\gamma$ transformation, the fine microstructure is maintained even after the pickling and the second (final) annealing process, which results in an improvement in stretch flange formability. In order to realize such effects, the Nb content is set to be 0.010% or more, or preferably 0.030% or more. On the other hand, in the case where the Nb content is excessive and more than 0.100%, since there is an increase in rolling load in the hot rolling process, and since there is an increase in deformation resistance in the cold rolling process, it is difficult to stably perform a practical manufacturing operation. Also, there is a marked decrease in workability due to a decrease in the ductility of ferrite. Therefore, the Nb content is set to be 0.100% or less. Therefore, the Nb content is set to be 0.010% or more and 0.100% or less, or preferably 0.030% or more and 0.100% or less.

Ti:0.010% or more and 0.100% or less

Ti, like Nb, contributes to an increase in strength by forming carbides and carbonitrides with C and N. In addition, since Ti has a function of decreasing the grain diameter of the microstructure of a hot-rolled steel sheet, and since Ti inhibits an increase in grain diameter in a recrystallization process, Ti contributes to an improvement in stretch flange formability and a decrease in the annealing-temperature dependency of mechanical properties by homogeneously decreasing the grain diameter of ferrite and martensite. Moreover, Ti, like Nb, raises the recrystallization temperature. Accordingly, by retaining non-recrystallized microstructure in a high temperature range in which Si and Mn easily diffuse, the diffusion of Si and Mn is promoted in the heating process of the first annealing process, and it is possible to form a Si—Mn-depleted layer in the surface layer of the steel sheet while forming the surface oxides of Si and Mn. The effect of this Si—Mn-depleted layer in the surface layer of the steel sheet contributes to an improvement in zinc coatability and surface appearance quality of the steel sheet after the pickling and the second annealing process. Moreover, by controlling the recrystallization temperature through the addition of Ti and by controlling a heating rate in the first annealing process, there is a decrease in the grain diameter of hard phases mainly including ferrite and martensite due to the simultaneous development of recrystallization and $\alpha$-$\gamma$ transformation, and thus the fine microstructure is maintained even after the pickling and the second (final) annealing process, which results in an improvement in stretch flange formability. In order to realize such effects, the Ti content is set to be 0.010% or more, or preferably 0.030% or more. On the other hand, in the case where the Ti content is more than 0.100%, the effects become saturated, and there is a decrease in the ductility of ferrite as a result of being precipitated in ferrite in an excessive amount. Therefore, the Ti content is set to be 0.100% or less. Accordingly, the Ti content is set to be 0.010% or more and 0.100% or less, or preferably the Ti content is set to be 0.030% or more and 0.100% or less.

It is preferable that the high-strength steel sheet according to aspects of the present invention have the chemical composition described above and contain C, Nb, Ti, N, and S so that relational expression (1) below is satisfied.

$$(Nb/93+Ti^*/48)/(C/12)\leq 0.12 \quad (1)$$

Here, $Ti^*=Ti-(48/14)N-(48/32)S$. In addition, in the equation for calculating Ti* and relational expression (1) above, C, Nb, Ti, N, and S respectively denote the contents (mass %) of the corresponding chemical elements in steel.

Here, (Nb/93+Ti*/48)/(C/12) indicates the atomic ratio of Ti and Nb to C, and, in the case where this value is more than 0.12, since there is an increase in the amounts of NbC and TiC precipitated, there may be a decrease in the ductility of a steel sheet due to a decrease in the deformation capability of ferrite, and there may be a decrease in manufacturing stability due to an increase in rolling load in the hot rolling process. Therefore, as indicated in relational expression (1) above, it is preferable that (Nb/93+Ti*/48)/(C/12) be 0.12 or less, or more preferably 0.08 or less.

In accordance with aspects of the present invention, one or more selected from among Mo, V, Cr, and B may further be added besides the essential additive chemical elements described above.

One or more selected from among Mo:0.05% or more and 1.00% or less, V:0.02% or more and 0.50% or less, Cr:0.05% or more and 1.00% or less, and B:0.0001% or more and 0.0030% or less Since Mo and Cr are chemical elements which contribute to an increase in strength by increasing hardenability and by forming martensite, these chemical elements may be added as needed. In order to realize such an effect, these chemical elements may be added in an amount of 0.05% or more each. On the other hand, in the case where the content of any of Mo and Cr is more than 1.00%, the effect described above becomes saturated, and there is an increase in material costs. Therefore, the content of each of these chemical elements is set to be 1.00% or less.

Since V, like Nb and Ti, contributes to an increase in strength by forming fine carbonitrides, V may be added as needed. In order to realize such an effect, it is preferable that the V content be 0.02% or more. On the other hand, in the case where the V content is more than 0.50%, the effect described above becomes saturated, and there is an increase in material costs. Therefore, the V content is set to be 0.50% or less.

B, like Mo and Cr, contributes to an increase in strength by improving hardenability, by inhibiting the formation of ferrite in a cooling process of the annealing process, and by forming martensite. In order to realize such an effect, B may be added in an amount of 0.0001% or more. On the other hand, in the case where the B content is more than 0.0030%, the effect described above becomes saturated. Therefore, the B content is set to be 0.0030% or less.

The remainder other than the constituent chemical elements above is Fe and inevitable impurities. However, as long as an effect of aspects of the present invention is not decreased, the chemical elements below may be appropriately added.

Cu is a harmful chemical element which causes a surface defect by causing cracking in the hot rolling process. However, since the negative effect of Cu on the properties of a steel sheet is small in accordance with aspects of the present invention, it is acceptable that the Cu content be 0.30% or less. With this, since it is possible to utilize recycled raw materials such as scrap, it is possible to decrease material costs.

Although Ni, like Cu, has a small effect on the properties of a steel sheet, Ni is effective for preventing a surface defect from occurring due to the addition of Cu. Such an effect is realized in the case where the Ni content is half the content of Cu or more. However, in the case where the Ni content is excessively large, the occurrence of another kind of surface defect which is caused by the inhomogeneous formation of scale is promoted. Therefore, in the case where Ni is added, the upper limit of the Ni content is set to be 0.30%.

Although Ca is effective for increasing ductility by controlling the shape of sulfides such as MnS, there is a tendency for such an effect to become saturated in the case where the Ca content is large. Therefore, in the case where Ca is added, the Ca content is set to be 0.0001% or more and 0.0020% or less.

Moreover, REM, which contributes to an improvement in workability as a result of being effective for controlling the shape of sulfide-based inclusions, and Sn and Sb, which have a function of homogenizing the diameter of grains in the surface of a steel sheet, may be added in an amount of 0.0001% to 0.020% each.

In addition, since it is preferable that the contents of, for example, Zr and Mg, which form precipitates, be as small as possible, and since it is not necessary to actively add such chemical elements, the content of such chemical elements is set to be less than 0.020%, or preferably less than 0.002%.

There is a case where Cu, Ni, Ca, REM, Sn, Sb, Zr, and Mg described above are contained as inevitable impurities in the steel sheet according to aspects of the present invention.

In accordance with aspects of the present invention, a galvanized steel sheet is manufactured by preparing molten steel having a chemical composition controlled to be within the range described above, by making the molten steel into a steel slab, and by sequentially performing a hot rolling process, in which the steel slab is hot-rolled into a hot-rolled steel sheet, a cold rolling process, in which the hot-rolled steel sheet is cold-rolled into a cold-rolled steel sheet, a first annealing process, in which the cold-rolled steel sheet is subjected to first annealing, a pickling process, in which the annealed cold-rolled steel is pickled, a second annealing process, in which the pickled cold-rolled steel sheet is subjected to second annealing (final annealing), in this order. In accordance with aspects of the present invention, the first annealing in the first annealing process includes performing heating to an annealing temperature of 780° C. or higher and 850° C. or lower at an average heating rate of 1° C./s or less in a temperature range from 700° C. to the annealing temperature, holding the heated steel sheet at an annealing temperature of 780° C. or higher and 850° C. or lower for 10 seconds or more and 500 seconds or less, and cooling the held steel sheet from the annealing temperature to a cooling stop temperature of 500° C. or lower at an average cooling rate of 5° C./s or more in order to obtain a steel sheet having a steel microstructure including ferrite in an amount of 10% or more and 60% or less in terms of area ratio, and martensite, bainite, and retained austenite in a total amount of 40% or more and 90% or less in terms of area ratio, and the second annealing in the second annealing process includes holding the heated steel sheet at an annealing temperature of 750° C. or higher and 850° C. or lower for 10 seconds or more and 500 seconds or less, cooling the held steel sheet from the annealing temperature at an average cooling rate of 1° C./s or more and 15° C./s or less, performing a galvanizing treatment including dipping the steel sheet in a galvanizing bath, cooling the galvanized steel sheet to a temperature of 150° C. or lower at an average cooling rate of 5° C./s or more and 100° C./s or less in order to obtain a steel sheet having a steel microstructure including, in terms of area ratio, 10% or more and 60% or less of ferrite and, in terms of area ratio, 40% or more and 90% or less of martensite.

First, the steel microstructure of the steel sheet after the first annealing process and the steel microstructure of the steel sheet after the second annealing process, which are the important constituent aspects of the present invention described above, will be described.

(Steel Microstructure of the Steel Sheet after the First Annealing Process)

In accordance with aspects of the present invention, in order to decrease the annealing-temperature dependency of mechanical properties in the second (final) annealing process, it is necessary that the steel microstructure of the steel sheet after the first annealing process be formed so as to include ferrite in an amount of, in terms of area ratio, 10% or more and 60% or less, and martensite, bainite, and retained austenite in a total amount of 40% or more and 90% or less in terms of area ratio.

The total area ratio of martensite, bainite, and retained austenite:40% or more and 90% or less The total area ratio of martensite, bainite, and retained austenite in the steel microstructure of the steel sheet after the first annealing process is one of the important factors for obtaining a high-strength steel sheet having small annealing-temperature dependency according to aspects of the present invention. That is, martensite, bainite, and retained austenite observed after the first annealing process are microstructures formed from austenite, in which chemical elements such as C and Mn are concentrated in the soaking process of the first annealing process, in the cooling process following the soaking process through transformation or as a result of the austenite being retained without transformation. Accordingly, the region including these microstructures has high contents of C and Mn. Such a region, in which C and Mn are concentrated, lowers the ferrite-austenite transformation temperature in the second annealing process, which results in the expansion of a dual phase temperature range (temperature range in which ferrite and austenite coexist). As a result, since there is a decrease in the deviation of the area ratio of martensite when annealing is performed in a temperature range of 750° C. or higher and 850° C. or lower in the second annealing process, there is also a decrease in the deviation of mechanical properties. Since the total area ratio of martensite, bainite, and retained austenite after the first annealing process generally has a correlation with the area ratio of martensite after the second (final) annealing process, the total area ratio of martensite, bainite, and retained austenite after the first annealing process is set to be 40% or more in order to satisfy the relationship TS≥1180 MPa after the second (final) annealing process. On the other hand, the diffusion rate of Si and Mn is lower in martensite, bainite, and retained austenite after the first annealing process, that is, an austenite phase in the soaking process of the annealing process than in a ferrite phase. Accordingly, in the case where the total area ratio is more than 90%, there are an insufficient amount of surface oxides of Si and Mn formed and an insufficient amount of Si—Mn-depleted layer formed in the surface layer of the steel sheet, which may result in a decrease in zinc coatability and surface appearance quality. Therefore, the total area ratio of martensite, bainite, and retained austenite after the first annealing process is set to be 90% or less, or preferably 70% or less.

The area ratio of ferrite:10% or more and 60% or less

Since a ferrite phase formed in the soaking process of the first annealing process or in the subsequent cooling process increases the contents of C and Mn in an austenite phase, the above-described region (C—Mn-concentrated region), in which C and Mn are concentrated, is formed. Since such a C—Mn-concentrated region lowers the ferrite-austenite transformation temperature in the second annealing process, there is a decrease in the deviation of the area ratio of martensite when annealing is performed in a temperature range of 750° C. or higher and 850° C. or lower in the second annealing process, which results in a decrease in the deviation of mechanical properties. In order to stably realize such an effect, the area ratio of ferrite after the first annealing process is set to be 10% or more. On the other hand, in the case where the area ratio of ferrite after the first annealing process is more than 60%, since it is difficult to form the desired amount of martensite after the second annealing process, it is difficult to stably achieve a TS of 1180 MPa or more. Therefore, the area ratio of ferrite after the first annealing process is set to be 60% or less.

Here, in accordance with aspects of the present invention, as described above, by actively adding Nb and Ti, which raises the recrystallization temperature, and by appropriately controlling a heating rate in the first annealing process, the diffusion of Si and Mn in the first annealing process is promoted due to the strain effect of a non-recrystallized microstructure, and it is possible to form a Si—Mn-depleted layer in the surface layer of the steel sheet while forming surface oxides. In accordance with aspects of the present invention, it is preferable that a Si—Mn-depleted layer (region in which the element concentration of Si and Mn is 3/4 or less of the element concentration of these chemical elements in the steel) in the surface layer of the steel sheet after the first annealing process, which is formed by performing the first annealing process under the specified conditions, extend over 2 μm or more from the surface layer of the steel sheet.

A Si—Mn-depleted layer in the surface layer of the steel sheet after the first annealing process is one of the important factors for achieving a good coated-surface appearance quality in the case of a high-strength steel sheet to which it is necessary to add large amounts of Si and Mn. That is, since Si and Mn contained in steel are subjected to selective oxidation even in a non-oxidizing atmosphere or a reducing atmosphere used in a general annealing furnace, Si and Mn are concentrated and form oxides on the surface of the steel, which results in a coating defect occurring due to a decrease in the wettability with molten zinc when a galvanizing treatment is performed. However, by forming a Si—Mn-depleted layer in the surface layer of the steel sheet after the first annealing process, since the surface concentration of Si and Mn in steel is inhibited from occurring again in the second annealing process by the Si—Mn-depleted layer in the surface layer of the steel sheet, it is possible to achieve a good coated-surface appearance quality. Such an effect is realized more evidently in the case where a region (hereinafter, referred to as "Si—Mn-depleted layer") in which the element concentration of Si and Mn is 3/4 or less of the element concentration of these chemical elements in the steel extends over a depth of 2 μm or more from the surface layer of the steel sheet. Therefore, it is preferable that the Si—Mn-depleted layer extend over 2 μm or more from the surface layer. In addition, it is preferable that the Si—Mn-depleted layer extend over 50 μm or less from the surface layer in order to prevent an excessive decrease in TS. Here, a region in which the element concentration of each of Si and Mn is 3/4 or less of the element concentration of the corresponding chemical element in the steel is determined by using a concentration profile in the depth direction obtained by performing glow discharge optical emission spectrometry (GDS), and the index of the Si—Mn-depleted layer was defined as the depth of the region.

(Steel Microstructure of the Steel Sheet after the Second Annealing Process)

Area ratio of ferrite:10% or more and 60% or less

A ferrite phase is an important factor for achieving satisfactory ductility, and, in the case where the area ratio of ferrite is less than 10%, it is difficult to achieve satisfactory ductility and there may be a decrease in workability. Therefore, the area ratio of ferrite in the steel microstructure of the steel sheet after the second annealing process is set to be 10% or more, or preferably 20% or more, in order to achieve satisfactory ductility. On the other hand, in the case where the area ratio of ferrite in the steel microstructure of the steel sheet after the second annealing process is more than 60%, it is difficult to achieve a TS of 1180 MPa or more. Therefore, the area ratio of ferrite in the steel microstructure of the steel sheet after the second annealing process is set to be 60% or less, or preferably 50% or less.

Here, in the case where the average grain diameter of ferrite is small, there is a decrease in the grain diameter of martensite, which is formed through reverse transformation occurring at the grain boundaries of ferrite grains, and there is an improvement in stretch flange formability. Therefore, it is preferable that the average grain diameter of ferrite in the steel microstructure of the steel sheet after the second annealing process be 10 μm or less, or more preferably 5 μm or less.

Area ratio of martensite:40% or more and 90% or less

Martensite is a hard phase which is necessary to achieve satisfactory strength for the steel sheet according to aspects of the present invention. In the case where the area ratio of martensite is less than 40%, there is a decrease in the strength of a steel sheet, and it may be difficult to achieve a TS of 1180 MPa or more. Therefore, the area ratio of martensite in the steel microstructure of the steel sheet after the second annealing process is set to be 40% or more, or preferably 50% or more. On the other hand, in the case where the area ratio of martensite is more than 90%, there is an excessive amount of hard phase, and it may be difficult to achieve satisfactory workability. Therefore, the area ratio of martensite in the steel microstructure of the steel sheet after the second annealing process is set to be 90% or less, or preferably 70% or less.

Here, in the case where the average grain diameter of martensite is more than 5 μm, voids tend to be formed at the interface between a soft ferrite and a hard martensite, and there may be a decrease in stretch flange formability and local ductility. In response to this problem, by controlling the average grain diameter of martensite to be 5 μm or less, the formation of voids at the interface between ferrite and martensite is inhibited, and a decrease in stretch flange formability is inhibited. Therefore, it is preferable that the average grain diameter of martensite in the steel microstructure of the steel sheet after the second annealing process be 5 μm or less, or more preferably 2 μm or less.

In addition, there is a case where the remaining microstructures such as pearlite, bainite, retained austenite, and carbides other than ferrite and martensite are contained in the steel sheet after the second annealing process according to aspects of the present invention, and it is acceptable that these microstructures be contained in an amount of 10% or less in total in terms of area ratio.

Here, it is possible to determine the area ratio described above by polishing the L-cross section (vertical cross section parallel to the rolling direction) of a steel sheet, by etching the cross section by using nital, by observing five fields of view in the cross section by using a SEM (scanning electron microscope) at a magnification of 2000 times in order to obtain microstructure photographs, and by performing image analysis on the photographs. As described in detail in EXAMPLES, in the microstructure photograph, ferrite is characterized by a region having a slightly black appearance, pearlite is characterized by a region in which carbides are formed in a lamellar shape, bainite is characterized by a region in which carbides are formed in a dotted line, and martensite and retained austenite (retained γ) are characterized by grains having a white appearance. In addition, the average grain diameters of ferrite and martensite were determined by using a cutting method in accordance with the prescription of JIS G 0522.

In addition, the high-strength galvanized steel sheet, which is the steel sheet having the steel microstructure described above after the second annealing process, has the properties described in items 1) through 3) below.

1) TS≥1180 MPa

Nowadays, since there is a strong demand for the weight reduction of automobiles and the achievement of occupant safety at the time of a vehicle collision, it is necessary to increase the strength of a steel sheet which is used as a raw material for automobiles in order to satisfy such demand. The high-strength galvanized steel sheet obtained in accordance with aspects of the present invention has a TS of 1180 MPa or more and satisfies such demand for increasing strength.

2) Deviation of TS (ΔTS)≤50 MPa, in the Case where the Annealing Temperature Varies by 40° C.

In manufacture in a continuous annealing line, an annealing temperature usually varies by about 40° C. (±20° C.) in a coil. In order to evaluate the deviation of mechanical properties due to a variation in annealing temperature, by taking JIS No. 5 tensile test pieces (JIS Z 2201) so that the tensile direction was a direction (C-direction) at an angle of 90° to the rolling direction from each of three positions, that is, a position corresponding to the central value of the annealing temperature and positions corresponding to a variation in annealing temperature of ±20° C., and by performing a tensile test in accordance with the prescription of JIS Z 2241, the deviation of TS, that is, the difference between the maximum value and minimum value of TS (ΔTS=TSmax−TSmin) was calculated. According to aspects of the present invention, it is possible to obtain a steel sheet having a small annealing-temperature dependency of mechanical properties corresponding to a ΔTS of 50 MPa or less.

3) Surface Appearance Quality

By evaluating the surface appearance quality of a steel sheet after the galvanizing process by performing a visual test, a case where no coating defect was observed was judged as ○, and a case where coating defect was observed was judged as x. In addition, by evaluating surface appearance quality after the alloying process by performing a visual test, a case where a variation in alloying was observed was judged as x, and a case where homogeneous surface appearance quality was obtained without a variation in alloying was observed was judged as ○. The high-strength galvanized steel sheet obtained in accordance with aspects of the present invention was judged as ○ after the galvanizing process and after the alloying process.

Hereafter, the manufacturing conditions according to aspects of the present invention will be described in detail.

Although it is preferable that the steel slab which is used in the manufacturing method according to aspects of the present invention be manufactured by using a continuous casting method in order to prevent the macro segregation of constituent chemical elements, an ingot-making method or a thin-slab-casting method may be used. In addition, besides a conventional method, in which the steel slab manufactured is first cooled to room temperature and then reheated, an energy-saving method such as a method (hot direct rolling), in which the steel slab is charged into a heating furnace in the hot state without being cooled and then hot-rolled, a method (hot direct rolling or direct rolling), in which the steel slab is subjected to heat retention for a short time and immediately hot-rolled, or a method (hot charge), in which the steel slab is charged into an heating furnace in the hot state in order to omit a part of a reheating process, may be used without causing any problem. In addition, it is preferable that the steel slab to be subjected to hot rolling be heated to a temperature of 1150° C. or higher and 1300° C. or lower for the reasons described below.

Slab heating temperature:1150° C. or higher and 1300° C. or lower

Since precipitates existing at the steel slab heating stage will exist in the form of precipitates having a large grain diameter in a steel sheet finally obtained and will not contribute to an increase in strength, it is necessary to redissolve sufficient amounts of Ti-based precipitates and Nb-based precipitates formed in a casting process. Also, heating to a temperature of 1150° C. or higher is effective for achieving a smooth steel sheet surface by decreasing the number of cracks and the degree of unevenness on the steel sheet surface as a result of removing defects such as blowholes and segregation from the slab surface through scale-off. Therefore, it is preferable that the slab heating temperature be 1150° C. or higher. On the other hand, in the case where the slab heating temperature is higher than 1300° C., since there is an increase in the grain diameter of austenite, the coarsening of the final microstructure occurs, which may result in a decrease in stretch flange formability. Therefore, it is preferable that the slab heating temperature be 1300° C. or lower.

(Hot Rolling Process)

The steel slab obtained as described above is subjected to hot rolling including rough rolling and finish rolling. First, the steel slab is made into a sheet bar by performing rough rolling. Here, it is not necessary to put particular limitation on what condition is used for rough rolling, and an ordinary method may be used. In addition, utilizing a sheet bar heater, which is used for heating the sheet bar, is effective for preventing problems from occurring due to a fall in surface temperature in the hot-rolling process.

It is preferable that hot rolling be performed with a rolling reduction of the final pass of finish rolling of 10% or more, a rolling reduction of the pass immediately before the final pass of finish rolling of 18% or more, and a finishing delivery temperature of 850° C. or higher and 950° C. or lower, although the manufacturing method according to aspects of the present invention is not particularly limited to this case.

Rolling reduction of the final pass of finish rolling:10% or more and rolling reduction of the pass immediately before the final pass of finish rolling:18% or more The steel according to aspects of the present invention, to which Nb and Ti are added, inhibits the recrystallization of austenite in the hot rolling process. Therefore, in the case where the rolling reduction of the final pass of finish rolling is less than 10%, there is an increase in the proportion of non-recrystallized austenite which undergoes ferrite transformation after hot finish rolling has been performed, the hot-rolled steel sheet tends to have a duplex grain microstructure. As a result, since the steel sheet microstructure tends to be inhomogeneous after the cold rolling process and the annealing process from the effect of the microstructure of the hot-rolled steel sheet, there may be an increase in the deviation of mechanical properties and a decrease in workability. In addition, in the case where the rolling reduction of the final pass of finish rolling is 10% or more, there is a decrease in the grain diameter of the microstructure of the hot-rolled steel sheet, and the fine microstructure is maintained even after the cold rolling process and the annealing process. Therefore, since there is a decrease in the grain diameter of ferrite and martensite after the second (final) annealing process, there is the effect of improving stretch flange formability. Accordingly, it is preferable that the rolling reduction of the final pass be 10% or more, or more preferably 13% or more.

Moreover, in addition to the control of the rolling reduction of the final pass described above, the rolling reduction of the pass immediately before the final pass is controlled to be within an appropriate range. That is, by controlling the rolling reduction of the pass immediately before the final pass to be 18% or more, the recrystallization of austenite is promoted to a higher level due to an increase in the effect of accumulated strain, and the inhomogeneity of the microstructure of the hot-rolled steel sheet is eliminated, which results in a decrease in the deviation of mechanical properties. In addition, in the case where the rolling reduction of the pass immediately before the final pass of finish rolling is 18% or more, there is a decrease in the grain diameter of the microstructure of the hot-rolled steel sheet, and the fine microstructure is maintained even after the cold rolling process and the annealing process. Therefore, since there is a decrease in the grain diameter of ferrite and martensite after the second (final) annealing process, there is the effect of improving stretch flange formability. On the other hand, in the case where the rolling reduction of the pass immediately before the final pass is less than 18%, there is a case where the effect of promoting the recrystallization of austenite or the effect of decreasing grain diameter is not realized. Therefore, it is preferable that the rolling reduction of the pass immediately before the final pass be 18% or more, or more preferably more than 20%.

Here, since there is an increase in rolling load in the case where there is an increase in the rolling reductions of the final pass and two passes immediately before the final pass, it is preferable that any of these rolling reductions be less than 40%.

Finishing delivery temperature:850° C. or higher and 950° C. or lower

In the case where the finishing delivery temperature is lower than 850° C., there is a marked decrease in workability (ductility and stretch flange formability) due to the inhomogeneity of a microstructure. On the other hand, in the case where the finishing delivery temperature is higher than 950° C., since there is a sharp increase in the amount of oxides (scale) formed, a rough interface is formed between the base steel and the oxides, which results in a tendency for the surface quality after the pickling process and the cold rolling process to decrease. In addition, since there is an excessive increase in grain diameter, an orange-peel-like surface defect may occur on the worked surface when press forming is performed. Therefore, it is preferable that the finishing delivery temperature be 850° C. or higher and 950° C. or lower.

In order to improve stretch flange formability and decrease the annealing-temperature dependency of mechanical properties due to a decrease in the grain diameter of the microstructure, it is preferable to start cooling the hot-rolled steel sheet (hereinafter, also referred to as "hot-rolled sheet"), which has been subjected to hot rolling as described above, within 3 seconds after hot finish rolling has been performed, to cool the hot-rolled steel sheet at an average cooling rate of 5° C./s or more and 200° C./s or less in a temperature range from the finishing delivery temperature of the hot rolling to a temperature of (the finishing delivery temperature of the hot rolling-100° C.), and to coil the hot-rolled steel sheet at a coiling temperature of 450° C. or higher and 650° C. or lower.

Starting cooling within 3 seconds after finish rolling has been performed

In the case where the time until cooling is started after finish rolling has been performed is more than 3 seconds, ferrite is precipitated, and the microstructure of the hot-rolled steel sheet tends to include a banded structure in which ferrite and pearlite are formed in layers. Since such a layered structure is in a state in which a variation occurs in the concentrations of the constituent chemical elements in the steel sheet, an inhomogeneous microstructure tends to be formed after the cold rolling process and the annealing process, which makes it difficult to form a homogeneous fine microstructure. Therefore, there may be a decrease in workability such as stretch flange formability and an increase in the deviation of TS due to a variation in annealing temperature. Therefore, it is preferable that cooling be started within 3 seconds after finish rolling has been performed.

Average cooling rate in a temperature range from the finishing delivery temperature to a temperature of (the finishing delivery temperature-100° C.) 5° C./s or more and 200° C./s or less In the case where the cooling rate in a temperature range from the finishing delivery temperature to a temperature of (the finishing delivery temperature-100° C.), which is a high temperature range immediately after finish rolling has been performed, is less than 5° C./s, there is an increase in the grain diameter of ferrite precipitated, and the microstructure of the hot-rolled steel sheet tends to have a large grain diameter and tends to include a banded structure in which ferrite and pearlite are formed in layers. Since such a banded structure is in a state in which a variation occurs in the concentrations of the constituent chemical elements in the steel sheet, an inhomogeneous microstructure tends to be formed after the cold rolling process and the annealing process, which makes it difficult to form a homogeneous fine microstructure. Therefore, there may be a decrease in workability such as stretch flange formability and an increase in the annealing-temperature dependency of mechanical properties. On the other hand, in the case where the average cooling rate is more than 200° C./s, since the effect becomes saturated, it is preferable that the average cooling rate in a temperature range from the finishing delivery temperature to a temperature of (the finishing delivery temperature-100° C.) be 5° C./s or more and 200° C./s or less.

Coiling temperature:450° C. or higher and 650° C. or lower

The coiling temperature has a significant influence on the precipitation of NbC. In the case where the coiling temperature is lower than 450° C., since there is an insufficient amount of NbC precipitated, NbC tends to be inhomogeneously precipitated in a coil, and there may be an increase in the annealing-temperature dependency of mechanical properties due to the inhomogeneity of the microstructure caused by the recrystallization behavior in the heating process of the annealing process following the cold rolling process. In addition, in the case where the coiling temperature is higher than 650° C., since the precipitation strengthening of ferrite through the use of NbC is insufficient due to an increase in the grain diameter of NbC precipitated, there is a case where the effect of improving stretch flange formability as a result of the effect of decreasing a difference in hardness with martensite is not realized. Therefore, it is preferable that the coiling temperature be 450° C. or higher and 650° C. or lower, or more preferably 500° C. or higher and 600° C. or lower.

(Cold Rolling Process)

The hot-rolled steel sheet which has been obtained by performing hot rolling in the hot rolling process is made into a cold-rolled steel sheet by appropriately performing pickling and by performing cold rolling. Pickling is not indispensable and may be appropriately performed. In addition, in the case where pickling is performed, ordinary conditions may be used. In addition, it is preferable that the rolling reduction of cold rolling be 40% or more.

Rolling reduction of cold rolling:40% or more

In the case where the rolling reduction of cold rolling is less than 40%, since recrystallization in the heating process of the annealing process inhomogeneously occurs, there is a case where it is not possible to form a homogeneous fine annealed microstructure. In addition, since a variation in the microstructure of the hot-rolled steel sheet, which may usually occur in a coil, is retained after the cold rolling process and the annealing process, there may be an increase in the annealing-temperature dependency of mechanical properties. Therefore, it is preferable that the rolling reduction of cold rolling be 40% or more in order to achieve a higher level of homogeneous fine microstructure in the coil. Here, in the case where the rolling reduction is more than 70%, since there is an increase in load placed on rolls when rolling is performed, there is a risk of threading troubles occurring. Therefore, it is more preferable that the upper limit of the rolling reduction be about 70%.

(First Annealing Process)

Average heating rate in a temperature range from 700° C. to the annealing temperature:1° C./s or less The cold-rolled steel sheet after the cold rolling process is subjected to first annealing. In accordance with aspects of the present invention, since TiC and NbC are precipitated at the hot-rolled steel sheet stage, the recrystallization temperature of the cold-rolled steel sheet obtained by performing the cold rolling process is comparatively high, which results in a tendency for a non-recrystallized microstructure to remain after the annealing process. Since such a non-recrystallized microstructure promotes the diffusion of Si and Mn, it is easy to form a Si—Mn-depleted layer in the surface layer of the steel sheet while forming the surface oxides of Si and Mn. As a result, an improvement in zinc coatability and surface appearance quality is anticipated after the pickling and the second annealing process. In order to realize such an effect, it is necessary that heating be performed at an average heating rate of 1° C./s or less in a temperature range from 700° C. to the annealing temperature. Here, although there is no particular limitation on the lower limit of the average heating rate, there is an increase in threading time through the annealing furnace in the case where the heating rate is less than 0.1° C./s, and there is a decrease in productivity. Therefore, it is preferable that the average heating rate in a temperature range from 700° C. to the annealing temperature be 0.1° C./s or more.

Heating to an annealing temperature of 780° C. or higher and 850° C. or lower

In the case where the annealing temperature is lower than 780° C., since it is not possible to form the specified amount of martensite, bainite, or retained austenite (retained γ) after the cooling process in the first annealing process, there is a case where it is difficult to obtain a high-strength steel sheet having small annealing-temperature dependency. In addition, since a non-recrystallized microstructure tends to remain even after the first annealing process, the surface concentration of Si and Mn tends to occur again due to a strain effect in the second annealing process, which may result in a coating defect. On the other hand, in the case where the annealing temperature is higher than 850° C., since it is not possible to form the desired amount of ferrite after the first annealing process, insufficient amounts of C and Mn are concentrated in austenite, which may result in an increase in the annealing-temperature dependency due to the deviation of the amount of martensite after the second annealing process. Moreover, there is a problem of a decrease in productivity and of an increase in energy costs. Therefore, the annealing temperature is set to be 780° C. or higher and 850° C. or lower.

Holding at an annealing temperature of 780° C. or higher and 850° C. or lower for 10 seconds or more and 500 seconds or less It is preferable that the holding time in the annealing temperature range of 780° C. or higher and 850° C. or lower be 10 seconds or more, or more preferably 20 seconds or more in the first annealing process, in order to promote the concentration of chemical elements such as C and Mn in austenite. On the other hand, in the case where the holding time is more than 500 seconds, since there is an increase in grain diameter, there is a risk of negative effects on the various properties of a steel sheet such as a decrease in strength, a decrease in surface quality, and a decrease in stretch flange formability. It is preferable that the holding time be 200 seconds or less. As described above, the holding time in the annealing temperature range of 780° C. or higher and 850° C. or lower, which is the annealing temperature range of the first annealing process, is set to be 10 seconds or more and 500 seconds or less.

Cooling from the annealing temperature to a cooling stop temperature of 500° C. or lower at an average cooling rate of 5° C./s or more This cooling process plays an important role in controlling the amounts of martensite, bainite, pearlite, and retained γ after the first annealing process. That is, in the case where the average cooling rate is less than 5° C./s, since an excessive amount of ferrite is formed during the cooling process, it is not possible to form the specified amount of martensite after the second (final) annealing process, which may make it impossible to achieve the desired TS. In addition, in the case where the cooling stop temperature is higher than 500° C., it is not possible to form the specified amount of martensite after the second (final) annealing process, which may make it impossible to achieve the desired TS. Therefore, the cooling stop temperature is set to be 500° C. or lower. Accordingly, the average cooling rate in a temperature range from the annealing temperature to a cooling stop temperature of 500° C. or lower is set to be 5° C./s or more, or preferably 10° C./s or more. On the other hand, it is preferable that the average cooling rate in a temperature range from the annealing temperature to a cooling stop temperature of 500° C. or lower be 100° C./s or less from the viewpoint of, for example, the stability of a sheet shape.

Although it is preferable that cooling be performed by using a gas cooling method, furnace cooling, mist cooling, roll cooling, or water cooling may be used separately or in combination.

It is preferable that the first annealing process described above be performed by using a continuous annealing method.

By performing the first annealing process as described above, the steel microstructure of the cold-rolled steel sheet after the first annealing process is controlled to include a ferrite phase in an amount of 10% or more and 60% or less in terms of area ratio, and martensite, bainite, and retained austenite in a total amount of 40% or more and 90% or less in terms of area ratio.

(Pickling Process)

Since the surface-concentration matter of easily oxidizable chemical elements such as Si and Mn which is formed in the first annealing process significantly decrease zinc coatability and surface appearance quality after the second annealing process, pickling is performed in order to improve zinc coatability and surface appearance quality by removing the surface-concentration matter of, for example, Si and Mn. Here, pickling may be performed under ordinary conditions. Here, since it is possible to completely remove the surface-concentration matter by performing pickling so that the amount of decrease in the weight of the steel sheet due to pickling is 0.05 $g/m^2$ or more and 5 $g/m^2$ or less in terms of Fe, and since, for example, it is possible to completely remove the surface-concentration matter by performing a pickling treatment by using an acid (such as hydrochloric acid, sulfuric acid, and nitric acid) having a temperature of 40° C. or higher and 90° C. or lower and a concentration of about 1 mass % or more and 10 mass % or less for 1 second or more and 20 seconds or less, it is preferable that the pickling process following the first annealing be performed under such conditions. In the case where the concentration of the pickling solution is less than 1 mass %, there is a case where the amount of decrease in weight due to pickling is less than 0.05 $g/m^2$ in terms of Fe, and thus there is a case where an insufficient amount of surface-concentration matter is removed by pickling. On the other hand, in the case where the concentration of the pickling solution is more than 10 mass %, there is a case where the amount of decrease in weight due to pickling is more than 5 $g/m^2$, and there is a case where surface deterioration occurs in the surface of the steel sheet due to over-pickling. In addition, in the case where the temperature of the acid is lower than 40° C., there is a case where the amount of decrease in weight due to pickling is less than 0.05 $g/m^2$ in terms of Fe, and thus there is a case where an insufficient amount of surface-concentration matter is removed by pickling. On the other hand, in the case where the temperature of the acid is higher than 90° C., there is a case where the amount of decrease in weight due to pickling is more than 5 $g/m^2$, and there is a case where surface deterioration occurs in the surface of the steel sheet due to over-pickling. There is a case where insufficient amount of surface-concentration matter is removed by pickling in the case where the pickling time is less than 1 second, and there is a case where surface deterioration occurs in the surface of the steel sheet due to over-pickling in the case where the pickling time is more than 20 seconds. Therefore, it is preferable that pickling be performed under conditions of an acid temperature of 40° C. or higher and 90° C. or lower, or more preferably 50° C. or higher and 70° C. or lower, an acid concentration of 1 mass % or more and 10 mass % or less, and a pickling time of 1 second or more and 20 seconds or less, or more preferably 5 seconds or more and 10 seconds or less.

It is possible to derive the amount of decrease in weight due to pickling in terms of Fe described above from the masses of the steel sheet before and after the pickling process.

(Second (Final) Annealing Process)

Heating to an annealing temperature of 750° C. or higher and 850° C. or lower

In the case where the annealing temperature in the second annealing process is lower than 750° C., it is not possible to form the specified amount of martensite after the cooling process of the annealing process, and therefore there is a case where it is not possible to achieve the desired strength. On the other hand, in the case where the annealing temperature is higher than 850° C., since the surface concentration of Si and Mn occurs again in the annealing process, there is a decrease in zinc coatability and surface appearance quality. In addition, since there is an increase in the gran diameter of a microstructure after the cooling process due to an increase in the grain diameters of ferrite and austenite, there is a decrease in the surface quality of the steel sheet, which may make it impossible to realize the effect of improving stretch flange formability. Moreover, there are problems of a decrease in productivity and of an increase in energy costs. Therefore, the annealing temperature is set to be 750° C. or higher and 850° C. or lower. It is preferable that the annealing temperature be 750° C. or higher and 80.0° C. or lower in order to achieve satisfactory zinc coatability and surface appearance quality more stably.

Holding at an annealing temperature of 750° C. or higher and 850° C. or lower for 10 seconds or more and 500 seconds or less It is preferable that the holding time at an annealing temperature of 750° C. or higher and 850° C. or lower in the second annealing process be 10 seconds or more in order to stabilize the concentration of chemical elements such as C and Mn in austenite to a higher degree. On the other hand, in the case where the holding time is more than 500 seconds, since the surface concentration of Si and Mn occurs again in the annealing process, there may be a decrease in zinc coatability and surface appearance quality. In addition, since there is an increase in grain diameter, there is a decrease in the surface quality of the steel sheet, which may cause negative effects on the various properties of the steel sheet such as a decrease in stretch flange formability. Therefore, the holding time at an annealing temperature of 750° C. or higher and 850° C. or lower is set to be 10 seconds or more and 500 seconds or less.

Average cooling rate (primary cooling rate) from the annealing temperature to the temperature of the galvanizing bath:1° C./s or more and 15° C./s or less The steel sheet, which has been heated to an annealing temperature in the temperature range described above, soaked at the annealing temperature, and held at an annealing temperature of 750° C. or higher and 850° C. or lower for 10 seconds or more and 500 seconds or less, is cooled to the temperature of the galvanizing bath, which is usually held at a temperature of 420° C. or higher and 500° C. or lower, at an average cooling rate of 1° C./s or more and 15° C./s or less. In the case where the average cooling rate (primary cooling rate) from the annealing temperature to the temperature of the galvanizing bath is more than 15° C./s, the formation of ferrite is inhibited in the cooling process and therefore excessive amounts of hard phases such as martensite and bainite are formed, which results in a decrease in workability such as ductility and stretch flange formability due to an excessive increase in strength. On the other hand, in the case where the cooling rate is less than 1° C./s, since there is an excessive increase in the amount of ferrite formed in the cooling process, there is a case where it is not possible to achieve the desired TS. Therefore, the average cooling rate from the annealing temperature to the temperature of the galvanizing bath is set to be 1° C./s or more and 15° C./s or less. Although it is preferable that cooling be performed by using a gas cooling method, furnace cooling, mist cooling, roll cooling, or water cooling may be used separately or in combination. It is preferable that the second annealing process described above be performed by using a continuous annealing method, in particular, by using a CGL (continuous galvanizing line) including a galvanizing treatment apparatus described below.

Galvanizing Treatment and Alloying Treatment

The steel sheet, which has been cooled at the primary cooling rate described above, is dipped in the galvanizing bath and subjected to a galvanizing treatment. A galvanizing treatment may be performed by using an ordinary method. In addition, an alloying treatment on a galvanizing layer may be performed before cooling is performed at an average cooling rate (secondary cooling rate) of 5° C./s or more and 100° C./s or less as described below after the steel sheet has been dipped in the galvanizing bath and subjected to a galvanizing treatment. In this case, such an alloying treatment on a galvanizing layer is performed, for example, by heating the steel sheet, which has been subjected to a galvanizing treatment, to a temperature of 500° C. to 650° C. and by holding the steel sheet for several seconds to several tens of seconds by using an ordinary method. It is preferable that a galvanizing treatment be performed under a condition of a coating weight of 20 g/m$^2$ to 70 g/m$^2$ per side, and, in the case where an alloying treatment is performed, it is preferable that Fe concentration (Fe %) in the coating layer be 6 mass % to 15 mass %.

Average cooling rate (secondary cooling rate) when cooling is performed to a temperature of 150° C. or lower after a galvanizing treatment has been performed or after an alloying treatment has further been performed in the case where an alloying treatment is performed:5° C./s or more and 100° C./s or less When cooling is performed after a galvanizing treatment has been performed or after an alloying treatment on a galvanized layer has been performed, in the case where slow cooling is performed at an average cooling rate (secondary cooling rate) of less than 5° C./s down to a temperature of 150° C. or lower, pearlite or bainite is formed at a temperature of about 400° C. to 500° C., and thus it is not possible to form the specified amount of martensite, which may make it impossible to achieve the desired strength. On the other hand, in the case where the secondary cooling rate is more than 100° C./s, since there is an excessive increase in the hardness of martensite, which may result in a decrease in ductility and stretch flange formability. Therefore, the secondary cooling rate is set to be 5° C./s or more and 100° C./s or less.

Moreover, in accordance with aspects of the present invention, the high-strength galvanized steel sheet, which is finally obtained after the second annealing process described above, may be subjected to skin pass rolling or leveling work for the purpose of shape correction or surface roughness control. Here, in the case where skin pass rolling is performed to an excessive degree, since an excessive strain is given to the steel sheet, a worked microstructure formed by rolling, in which crystal grains are elongated, is formed, which results in a decrease in ductility. Therefore, in the case where skin pass rolling is performed, it is preferable that rolling reduction be about 0.1% to 1.5% in terms of elongation ratio.

EXAMPLE 1

By preparing molten steels having the chemical compositions given in Table 1, by casting the molten steels into steel slabs, and by performing a hot rolling process, a cold rolling process, a first annealing process, a pickling process, and a second annealing process under the various conditions given in Table 2, high-strength galvannealed steel sheets (product sheets) having a thickness of 1.2 mm were manufactured. The holding time in the annealing temperature range of the first annealing process refers to the holding time in an annealing temperature range (annealing temperature range of the first annealing process) of 780° C. or higher and 850° C. or lower, and the holding time in the annealing temperature range of the second annealing process refers to the holding time in an annealing temperature range (annealing temperature range of the second annealing process) of 750° C. or higher and 850° C. or lower. In addition, in the pickling process following the first annealing process, pickling was performed in a 5 mass %-hydrochloric acid solution having a temperature of 60° C. for 10 seconds. In addition, a galvanizing treatment was performed so that coating weight was 50 g/m$^2$ per side (double-sided coating), and an alloying treatment was further performed so that Fe in the coating layer was 9 mass % to 12 mass %.

By taking a sample from the galvannealed steel sheet obtained as described above, by performing microstructure observation and a tensile test with the tensile direction being a direction (C-direction) at an angle of 90° to the rolling direction by using the methods described below, the steel microstructures of the steel sheet were identified, and the area ratios of a ferrite phase and a martensite phase, the average grain diameters of ferrite and martensite, yield strength (YP), tensile strength (TS), total elongation (El), and hole expansion ratio (λ) were determined. In addition, surface quality was evaluated by performing a visual test on surface appearance quality after the galvanizing process and surface appearance quality after the alloying process. Moreover, by performing a tensile test on tensile test pieces taken from positions corresponding to a variation in second annealing temperature of ±20° C. from the central value so that the tensile direction was a direction (C-direction) at an angle of 90° to the rolling direction, the deviation of TS (ΔTS) in the case where the second annealing temperature varied by ±20° C. from the central value, that is, in the case where the annealing temperature varied by 40° C. was evaluated. Also, a sample for steel microstructure observation was taken from the steel sheet before the pickling process following the first annealing process. Hereafter, a specific description will be given.

(i) Microstructure Observation

By taking a test piece for microstructure observation from the galvannealed steel sheet, by mechanically polishing the L-cross section (vertical cross section parallel to the rolling direction) of the test piece, by performing nital etching, by deriving a microstructure photograph (SEM photograph) by using a scanning electron microscope (SEM) at a magnification of 3000 times, and by using the photograph, the microstructures of the steel sheet were identified, and the area ratios of ferrite and martensite were determined. Here, when the steel microstructures of the steel sheet were identified from the microstructure photograph, ferrite was characterized by a region having a slightly black appearance, pearlite was characterized by a region in which carbides were formed in a lamellar shape, bainite was characterized by a region in which carbides were formed in a dotted line, and martensite and retained austenite (retained γ) were characterized by grains having a white appearance. Moreover, by performing a tempering treatment on the test piece described above at a temperature of 250° C. for 4 hours, by then deriving a microstructure photograph as described above, by identifying a region in which carbides were formed in a lamellar shape as a region of pearlite before the heat treatment, by identifying a region in which carbides were formed in a dotted line as a region of bainite or martensite before the heat treatment, by then determining the area ratios of the regions again, by identifying retained fine grains having a white appearance as retained γ in order to determine the area ratio, the area ratio of martensite was calculated as the difference from the area ratio of the grains having a white appearance before the tempering treatment (martensite and retained γ). Here, the area ratio of each of the phases was determined by coloring the different phases with different colors in an image printed on a transparent sheet for an OHP, by binarizing the image, and by using image analysis software (Digital Image Pro Plus ver. 4.0 produced by Microsoft Corporation). In addition, the average grain diameters of ferrite and martensite were determined by using a cutting method in accordance with the prescription in JIS G 0522.

In addition, in the case of the test piece for microstructure observation taken from the steel sheet after the first annealing process, by mechanically polishing the L-cross section (vertical cross section parallel to the rolling direction) of the test piece, by performing nital etching, by deriving a microstructure photograph (SEM photograph) by using a scanning electron microscope (SEM) at a magnification of 3000 times, and by using the photograph, the steel sheet microstructures were identified, and the area ratio of ferrite was determined. Moreover, by determining a region in which the element concentration of each of Si and Mn is 3/4 or less of the element concentration of the corresponding chemical element in the steel by using a concentration profile in the depth direction obtained by performing glow discharge optical emission spectrometry (GDS), the index of the depth of a Si—Mn-depleted layer was defined as the depth of the region.

(ii) Tensile Properties

By taking a JIS No. 5 tensile test piece (JIS Z 2201) from the galvannealed steel sheet so that the tensile direction was a direction (C-direction) at an angle of 90° to the rolling direction, and by performing a tensile test on the test piece in accordance with the prescription in JIS Z 2241, YP, TS, El were determined. Here, the evaluation criteria for the tensile test were TS≥1180 MPa and TS×El≥15000 MPa·%.

Moreover, by taking tensile test pieces from positions respectively corresponding to a variation in the second annealing temperature from the central value of +20° C. and −20° C. so that the tensile direction is a direction (C-direction) at an angle of 90° to the rolling direction, and by performing a tensile test, the deviation of TS (ΔTS) in the case where the annealing temperature varied by 40° C. was evaluated. Here, as the evaluation criterion of the homogeneity of mechanical properties, a case where ΔTS was 50 MPa or less was judged as the case where the homogeneity of mechanical properties is excellent.

(iii) Hole Expansion Ratio (Stretch Flange Formability)

Stretch flange formability was evaluated by performing a hole expansion test in accordance with The Japan Iron and Steel Federation Standard JFS T 1001. That is, by taking a sample having a square size of 100 mm×100 mm from the obtained galvannealed steel sheet, by punching a hole in the sample by using a punch having a punch diameter of 10 mm, and by performing a hole expansion test by using a conical punch having a tip angle of 60° so that the burr was on the outside until a crack penetrate through the thickness of the steel sheet, hole expansion ratio $\lambda$ (%)={(d−d0)/d0}×100 was derived, where d0 denotes the initial hole diameter (mm) and d denotes the hole diameter (mm) when the crack occurred. Here, as the evaluation criterion of the hole expansion ratio, a case where TS×λ was 43000 MPa·% or more was judged as the case where stretch flange formability was excellent.

(iv) Surface Quality

By evaluating surface appearance quality after the galvanizing process by performing a visual test, a case where a coating defect was not observed was judged as ○, and a case where a coating defect was observed was judged as x. In addition, in the case of surface appearance quality after the alloying process, a case where a variation in alloying was observed was judged as x, and a case where homogeneous surface appearance quality was achieved without a variation in alloying was judged as ○.

The obtained results are given in Table 3. As Table 3 indicates, steel sheet Nos. 2 through 9, which were the examples of the present invention manufactured by using the chemical compositions and the manufacturing methods according to aspects of the present invention, were steel sheets which satisfied the relationships TS≥1180 MPa, TS×El≥15000 MPa·%, and TS×λ≥43000 MPa·% and which were excellent in terms of annealing-temperature dependency so that the deviation of TS (ΔTS) in the case where the annealing temperature varied by 40° C. was 50 MPa or less. In addition, no coating defect or no variation in alloying was observed, which means that these steel sheets had good surface quality. Moreover, in the case of steel sheet Nos. 3 and 5 through 8, since the rolling reductions of the last pass and a pass immediately before the last pass in the hot rolling process were within the preferable ranges, the average grain diameter of martensite was 2 μm or less, which resulted in the relationship TS×λ≥45000 MPa·% being satisfied.

In contrast, in the case of steel sheet No. 1, which was a comparative example having C content less than the range according to aspects of the present invention, since the desired amount of martensite was not formed, the relationship TS≥1180 MPa was not satisfied. In the case of steel sheet No. 10, which was a comparative example having Nb content and Ti content less than the ranges according to aspects of the present invention, since the precipitation strengthening of ferrite was insufficient, the effect of decreasing the difference in hardness with a martensite phase was small, which resulted in the relationship TS×λ≥43000 MPa·% being unsatisfied. Moreover, this is a comparative example, in which, since the desired depth of a Si—Mn-depleted layer was not achieved, a coating defect and a variation in alloying occurred. In the case of steel sheet No. 11, which was a comparative example having S content, Nb content, and Ti content more than the ranges according to aspects of the present invention, there is a significant decrease in the ductility of ferrite, which resulted in the relationship TS×El≥15000 MPa·% being unsatisfied. In addition, since the Nb content and the Ti content were excessively large, a rolling load in the hot rolling process was rather high, which raises a risk of a decrease in manufacturability. In the case of steel sheet No. 12, which was a comparative example having C content, Si content, and Mn content more than the ranges according to aspects of the present invention, since an excessive amount of martensite was formed, there was a decrease in El and λ, which resulted in the relationship TS×El≥15000 MPa·% or TS×λ≥43000 MPa·% being unsatisfied.

TABLE 1

| Steel | Chemical Composition (mass %) | | | | | | | | | | | | | | |
|---|---|---|---|---|---|---|---|---|---|---|---|---|---|---|---|
| Code | C | Si | Mn | P | S | sol.Al | N | Nb | Ti | Mo | V | Cr | B | (Nb/93 + Ti*/48)/(C/12) | Note |
| A | 0.105 | 0.02 | 2.08 | 0.011 | 0.005 | 0.038 | 0.0021 | 0.041 | 0.032 | — | — | — | — | 0.091 | Comparative Steel |
| B | 0.127 | 0.12 | 2.50 | 0.008 | 0.003 | 0.031 | 0.0033 | 0.021 | 0.022 | 0.21 | — | — | 0.0015 | 0.033 | Example Steel |
| C | 0.125 | 0.09 | 3.23 | 0.015 | 0.008 | 0.037 | 0.0039 | 0.033 | 0.035 | — | — | — | 0.0013 | 0.054 | Example Steel |
| D | 0.131 | 0.22 | 2.66 | 0.013 | 0.003 | 0.038 | 0.0043 | 0.048 | 0.031 | — | — | — | — | 0.070 | Example Steel |
| E | 0.134 | 0.25 | 2.57 | 0.013 | 0.003 | 0.038 | 0.0041 | 0.061 | 0.051 | 0.17 | — | — | 0.0011 | 0.118 | Example Steel |
| F | 0.142 | 0.33 | 2.71 | 0.007 | 0.001 | 0.037 | 0.0035 | 0.040 | 0.019 | 0.11 | — | — | — | 0.047 | Example Steel |
| G | 0.146 | 0.48 | 2.92 | 0.013 | 0.003 | 0.038 | 0.0035 | 0.049 | 0.060 | — | 0.05 | 0.15 | — | 0.119 | Example Steel |
| H | 0.147 | 0.85 | 2.34 | 0.007 | 0.001 | 0.037 | 0.0035 | 0.041 | 0.021 | — | — | 0.51 | — | 0.050 | Example Steel |
| I | 0.177 | 0.22 | 2.41 | 0.011 | 0.009 | 0.049 | 0.0055 | 0.072 | 0.079 | — | — | — | — | 0.119 | Example Steel |
| J | 0.135 | 0.24 | 2.62 | 0.011 | 0.009 | 0.045 | 0.0044 | 0.004 | 0.004 | — | — | — | — | 0.004 | Comparative Steel |
| K | 0.148 | 0.44 | 2.81 | 0.033 | 0.011 | 0.033 | 0.0058 | 0.110 | 0.110 | — | — | — | — | 0.221 | Comparative Steel |
| L | 0.189 | 1.05 | 3.62 | 0.021 | 0.008 | 0.041 | 0.0035 | 0.030 | 0.079 | — | — | — | — | 0.093 | Comparative Steel |

Ti* = Ti − (48/14)N − (48/32)S

TABLE 2

| Steel Sheet No. | Steel Code | Slab Heating Temperature (° C.) | Hot Rolling Process: Pass Immediately before Last pass Rolling Temperature (° C.) | Pass Immediately before Last pass Rolling Reduction (%) | Last pass Rolling Temperature (° C.) | Last pass Rolling Reduction (° C.) | Cooling Start Time (sec) | Average Cooling Rate (° C./s) *1 | Coiling Temperature (° C.) | Cold Rolling Process Rolling Reduction (%) | First Annealing Process: Average Heating Rate from 700° C. to Annealing Temperature (° C./s) | Annealing Temperature (° C.) | Holding Time in Annealing Temperature Range (sec) |
|---|---|---|---|---|---|---|---|---|---|---|---|---|---|
| 1 | A | 1220 | 940 | 19 | 890 | 13 | 1 | 50 | 550 | 50 | 0.5 | 800 | 100 |
| 2 | B | 1220 | 940 | 19 | 890 | 13 | 1 | 50 | 550 | 50 | 0.5 | 800 | 100 |
| 3 | C | 1220 | 940 | 22 | 890 | 15 | 2 | 50 | 550 | 50 | 0.5 | 800 | 100 |
| 4 | D | 1220 | 940 | 19 | 890 | 13 | 2 | 50 | 550 | 50 | 0.5 | 800 | 100 |
| 5 | E | 1220 | 940 | 22 | 890 | 15 | 2 | 50 | 550 | 50 | 0.5 | 800 | 100 |
| 6 | F | 1220 | 940 | 22 | 890 | 15 | 2 | 50 | 550 | 50 | 0.5 | 800 | 100 |
| 7 | G | 1220 | 940 | 22 | 890 | 15 | 1 | 50 | 550 | 50 | 0.5 | 800 | 100 |
| 8 | H | 1220 | 940 | 22 | 890 | 15 | 1 | 50 | 550 | 50 | 0.5 | 800 | 100 |
| 9 | I | 1220 | 940 | 19 | 890 | 13 | 3 | 50 | 550 | 50 | 0.5 | 800 | 100 |
| 10 | J | 1220 | 940 | 19 | 890 | 13 | 3 | 50 | 550 | 50 | 0.5 | 800 | 100 |
| 11 | K | 1220 | 940 | 19 | 890 | 13 | 3 | 50 | 550 | 50 | 0.5 | 800 | 100 |
| 12 | L | 1220 | 940 | 19 | 890 | 13 | 1 | 50 | 550 | 50 | 0.5 | 800 | 100 |

| Steel Sheet No. | Steel Code | First Annealing Process: Average Cooling Rate (° C./s) *2 | First Annealing Process: Area Ratio of Ferrite Phase (%) | First Annealing Process: Total Area ratio of Hard Phase (%)*3 | First Annealing Process: Depth of Si—Mn-depleted Layer (μm)*4 | Pickling Process*5: Amount of Decrease in Weight due to Pickling ($g/m^2$) | Second Annealing Process: Holding: Annealing Temperature (° C.) | Second Annealing Process: Holding: Time in Annealing Temperature Range (sec) | Second Annealing Process: Primary Cooling Rate (° C./s)*6 | Second Annealing Process: Alloying Condition | Second Annealing Process: Secondary Cooling Rate (° C./2) *7 | Skin Pass Rolling Process Elongation Ratio (%) |
|---|---|---|---|---|---|---|---|---|---|---|---|---|
| 1 | A | 5 | 67 | 33 | 2.4 | 0.5 | 800 ± 20 | 100 | 3 | 520° C. × 20 s | 15 | 0.3 |
| 2 | B | 5 | 56 | 44 | 2.1 | 0.5 | 800 ± 20 | 100 | 3 | 520° C. × 20 s | 15 | 0.3 |
| 3 | C | 5 | 52 | 48 | 2.8 | 0.5 | 800 ± 20 | 100 | 3 | 520° C. × 20 s | 15 | 0.3 |
| 4 | D | 5 | 50 | 50 | 2.5 | 0.5 | 800 ± 20 | 100 | 3 | 520° C. × 20 s | 15 | 0.3 |
| 5 | E | 5 | 52 | 48 | 3.3 | 0.5 | 800 ± 20 | 100 | 3 | 520° C. × 20 s | 15 | 0.3 |
| 6 | F | 5 | 45 | 55 | 2.5 | 0.5 | 800 ± 20 | 100 | 3 | 520° C. × 20 s | 15 | 0.3 |
| 7 | G | 5 | 50 | 50 | 3.3 | 0.5 | 800 ± 20 | 100 | 3 | 520° C. × 20 s | 15 | 0.3 |
| 8 | H | 5 | 57 | 43 | 2.7 | 0.5 | 800 ± 20 | 100 | 3 | 520° C. × 20 s | 15 | 0.3 |
| 9 | I | 5 | 24 | 76 | 3.5 | 0.5 | 800 ± 20 | 100 | 3 | 520° C. × 20 s | 15 | 0.3 |
| 10 | J | 5 | 48 | 52 | 1.3 | 0.5 | 800 ± 20 | 100 | 3 | 520° C. × 20 s | 15 | 0.3 |
| 11 | K | 5 | 39 | 61 | 4.5 | 0.5 | 800 ± 20 | 100 | 3 | 520° C. × 20 s | 15 | 0.3 |
| 12 | L | 5 | 7 | 93 | 2.9 | 0.5 | 800 ± 20 | 100 | 3 | 520° C. × 20 s | 15 | 0.3 |

*1: average cooling rate from the finishing delivery temperature to a temperature of the finishing delivery temperature - 100° C.)

*2: average cooling rate from the annealing temperature to a cooling stop temperature of 500° C. or lower

*3: the total area ratio of martensite, bainite, and retained γ

*4: depth from the surface layer of the steel sheet over which the element concentration of Si and Mn is ¾ or less of the element concentration of these chemical elements in the steel

*5: pickling performed in a 5 mass %-hydrochloric acid solution having a temperature of 60° C. for 10 seconds

*6: average cooling rate from the annealing temperature to the temperature of the galvanizing bath

*7: average cooling rate to a temperature of 150° C. or lower after a galvanizing treatment or an alloying treatment on the galvanizing layer has been performed

TABLE 3

| | | Steel Microstructure | | | | | Mechanical Properties | | | | | | | Surface Quality | | |
|---|---|---|---|---|---|---|---|---|---|---|---|---|---|---|---|---|
| | | Ferrite | | Martensite | | | | | | | | | | | | |
| Steel Sheet No. | Steel Code | Area Ratio (%) | Average Grain Diameter (μm) | Area Ratio (%) | Average Grain Diameter (μm) | Remainder* Area Ratio (%) | YP (MPa) | TS (MPa) | EI (%) | λ (%) | TS × EI (MPa · %) | TS × λ (MPa · %) | ΔTS (MPa) | Surface Appearance Quality after Galvanizing | Surface Appearance Quality after Alloying | Note |
| 1 | A | 63 | 5.2 | 30 | 3.5 | 7(P, B) | 587 | 900 | 18.2 | 48 | 16380 | 43200 | 36 | ○ (without Coating Defect) | ○ (without variation in Alloying) | Comparative Example |
| 2 | B | 31 | 4.5 | 65 | 2.5 | 4(B) | 773 | 1268 | 12.0 | 34 | 15216 | 43112 | 44 | ○ (without Coating Defect) | ○ (without variation in Alloying) | Example |
| 3 | C | 29 | 4.2 | 68 | 1.9 | 3(B) | 838 | 1299 | 11.8 | 35 | 15328 | 45465 | 45 | ○ (without Coating Defect) | ○ (without variation in Alloying) | Example |
| 4 | D | 37 | 3.9 | 57 | 2.3 | 6(B, γ) | 789 | 1195 | 12.6 | 36 | 15057 | 43020 | 42 | ○ (without Coating Defect) | ○ (without variation in Alloying) | Example |
| 5 | E | 23 | 4.0 | 73 | 1.6 | 4(B, γ) | 955 | 1352 | 11.2 | 34 | 15142 | 45968 | 46 | ○ (without Coating Defect) | ○ (without variation in Alloying) | Example |
| 6 | F | 22 | 4.2 | 74 | 1.8 | 4(B, γ) | 871 | 1377 | 11.1 | 33 | 15285 | 45441 | 42 | ○ (without Coating Defect) | ○ (without variation in Alloying) | Example |
| 7 | G | 18 | 3.9 | 77 | 1.9 | 5(B, γ) | 975 | 1388 | 10.9 | 33 | 15129 | 45804 | 42 | ○ (without Coating Defect) | ○ (without variation in Alloying) | Example |
| 8 | H | 27 | 4.3 | 69 | 1.9 | 4(B, γ) | 853 | 1340 | 11.3 | 34 | 15142 | 45560 | 42 | ○ (without Coating Defect) | ○ (without variation in Alloying) | Example |
| 9 | I | 15 | 4.8 | 80 | 2.9 | 5(B, γ) | 1040 | 1425 | 10.8 | 31 | 15390 | 44175 | 48 | ○ (without Coating Defect) | ○ (without variation in Alloying) | Example |
| 10 | J | 36 | 4.2 | 58 | 2.6 | 6(B, γ) | 672 | 1195 | 12.6 | 21 | 15057 | 25095 | 41 | x (with Coating Defect) | x (with Variation in Alloying) | Comparative Example |
| 11 | K | 32 | 4.7 | 63 | 3.4 | 5(B, γ) | 1069 | 1246 | 9.3 | 35 | 11588 | 43610 | 46 | ○ (without Coating Defect) | ○ (without variation in Alloying) | Comparative Example |
| 12 | L | 5 | 7.8 | 95 | 4.9 | — | 1112 | 1583 | 2.7 | 12 | 4274 | 18996 | 58 | ○ (without Coating Defect) | ○ (without variation in Alloying) | Comparative Example |

*P: pearlite, B: bainite, and γ: retained austenite (retained γ)

EXAMPLE 2

By preparing molten steels having the chemical compositions B, C, D, and I given in Table 1, by casting the molten steels into steel slabs, and by performing a hot rolling process, a cold rolling process, a first annealing process, a pickling process, and a second annealing process under the various conditions given in Table 4, high-strength galvanized steel sheets (galvanized steel sheets which were not subjected to an alloying treatment (simply referred to as "galvanized steel sheet" in Table 4) and galvannealed steel sheet which were galvanized steel sheet subjected to an alloying treatment) (product sheets) having a thickness of 1.2 mm were manufactured. The holding time in the annealing temperature range of the first annealing process refers to the holding time in an annealing temperature range (annealing temperature range of the first annealing process) of 780° C. or higher and 850° C. or lower, and the holding time in the annealing temperature range of the second annealing process refers to the holding time in an annealing temperature range (annealing temperature range of the second annealing process) of 750° C. or higher and 850° C. or lower. In addition, in the pickling process following the first annealing process, pickling was performed in a 5 mass %-hydrochloric acid solution having a temperature of 60° C. for 10 seconds. Here, a galvanizing treatment was performed so that coating weight was 50 g/m$^2$ per side (double-sided coating), and, in the case where an alloying treatment was performed, an alloying treatment was performed so that Fe % in the coating layer was 9 mass % to 12 mass %.

By performing the same investigations as those performed in the EXAMPLE 1 on the various high-strength galvanized steel sheet (product sheets) obtained as described above, the steel sheet microstructures were identified, the area ratios of a ferrite phase and a martensite phase, the average grain diameters of ferrite and martensite, YP, TS, El, and λ were determined, and, moreover, the deviation of TS (ΔTS) in the case where the annealing temperature varied by 40° C. was evaluated.

The determined results obtained as described above are given in Table 5. As Table 5 indicates, steel sheet Nos. 13 through 15, 18 through 21, and 23 through 25, which satisfied the manufacturing conditions according to aspects of the invention and were the examples of the present invention manufactured by using the chemical compositions and the manufacturing methods according to aspects of the present invention, were steel sheets which satisfied the relationships TS≥1180 MPa, TS×El≥15000 MPa·%, and TS×λ≥43000 MPa·% and which were excellent in terms of annealing-temperature dependency so that the deviation of TS (ΔTS) in the case where the annealing temperature varied by 40° C. was 50 MPa or less. In addition, no coating defect or no variation in alloying was observed, which means that these steel sheets had good surface quality. Moreover, in the case of steel sheet Nos. 14, 15 and 18, since the rolling reductions of the last pass and a pass immediately before the last pass in the hot rolling process were within the preferable ranges, the average grain diameter of martensite was 2 μm or less, which resulted in the relationship TS×λ≥45000 MPa·% being satisfied.

In contrast, steel sheet No. 16 was a comparative example in which, since the amount of decrease in weight due to pickling in the pickling process was less than the range according to aspects of the present invention, the surface-concentration matter of easily oxidizable chemical elements such as Si and Mn which had been formed in the first annealing process are retained, which resulted in a coating defect and a variation in alloying occurring. Steel sheet No. 17 was a comparative example in which, since the amount of decrease in weight due to pickling in the pickling process was more than the upper limit of the range according to aspects of the present invention, a coating defect and a variation in alloying occurred as a result of surface deterioration occurring in the surface of the steel sheet due to over-pickling. Steel sheet No. 22 is a comparative example in which, since the secondary cooling rate in the second annealing process was less than the range according to aspects of the present invention, it was not possible to form the desired amount of martensite due to large amounts of pearlite and bainite precipitated in the cooling process, which resulted in the relationship TS≥1180 MPa being unsatisfied. In addition, this was a comparative example in which, since the heating rate in the first annealing process was more than the range according to aspects of the present invention, it was not possible to achieve the desired depth of a Si—Mn-depleted layer due to insufficient diffusion of Si and Mn, which resulted in a coating defect and a variation in alloying occurring. In the case of steel sheet No. 26, which was a comparative example, since the annealing temperature in the first annealing process was higher than the range according to aspects of the present invention, ΔTS was unsatisfactory. In the case of steel sheet No. 27, which was a comparative example, since the holding time in the annealing temperature range in the first annealing process was more than the range according to aspects of the present invention, stretch flange formability was unsatisfactory. In the case of steel sheet No. 28, which was a comparative example, since the primary cooling rate in the second annealing process was more than the range according to aspects of the present invention, the area ratio of ferrite in the steel microstructure was unsatisfactory, and elongation and stretch flange formability were unsatisfactory. In the case of steel sheet No. 29, which was a comparative example, since the secondary cooling rate in the second annealing process was more than the range according to aspects of the present invention, elongation and stretch flange formability were unsatisfactory.

Steel sheet No. 30 was a comparative example in which, since the annealing temperature in the second annealing process was higher than the range according to aspects of the present invention, the surface concentration of Si and Mn occurred again in the second annealing process, which resulted in a coating defect and a variation in alloying occurring. In the case of steel sheet No. 31, which was a comparative example, since the annealing temperature in the second annealing process was lower than the range according to aspects of the present invention, it was not possible to achieve the desired ferrite phase fraction or martensite phase fraction in the steel sheet after the second annealing process, which resulted in the relationship TS≥1180 MPa being unsatisfied.

TABLE 4

| Steel Sheet No. | Steel Code | Slab Heating Temperature (° C.) | Hot Rolling Process: Pass Immediately before Last pass Rolling Temperature (° C.) | Pass Immediately before Last pass Rolling Reduction (%) | Last pass Rolling Temperature (° C.) | Last pass Rolling Reduction (%) | Cooling Start Time (sec) | Average Cooling Rate (° C./s)*1 | Coiling Temperature (° C.) | Cold Rolling Process Rolling Reduction (%) | First Annealing Process: Average Heating Rate from 700° C. to Annealing Temperature (° C./s) | Annealing Temperature (° C.) | Holding Time in Annealing Temperature Range (sec) | Average Cooling Rate (° C./s)*2 |
|---|---|---|---|---|---|---|---|---|---|---|---|---|---|---|
| 13 | B | 1220 | 940 | 19 | 890 | 13 | 1 | 50 | 550 | 50 | 0.5 | 800 | 100 | 5 |
| 14 | B | 1220 | 940 | 22 | 890 | 15 | 1 | 100 | 520 | 60 | 0.5 | 820 | 100 | 10 |
| 15 | B | 1220 | 940 | 22 | 890 | 15 | 2 | 150 | 580 | 60 | 0.5 | 820 | 100 | 10 |
| 16 | B | 1220 | 940 | 19 | 890 | 13 | 2 | 50 | 550 | 50 | 0.5 | 800 | 100 | 5 |
| 17 | B | 1220 | 940 | 19 | 890 | 13 | 2 | 50 | 550 | 50 | 0.5 | 800 | 100 | 5 |
| 18 | C | 1220 | 940 | 22 | 890 | 15 | 2 | 50 | 550 | 50 | 0.5 | 800 | 100 | 5 |
| 19 | C | 1220 | 940 | 19 | 890 | 13 | 1 | 50 | 480 | 50 | 1 | 800 | 300 | 5 |
| 20 | C | 1220 | 940 | 19 | 890 | 13 | 1 | 50 | 630 | 50 | 0.5 | 840 | 300 | 10 |
| 21 | D | 1220 | 940 | 19 | 890 | 13 | 3 | 50 | 550 | 50 | 0.5 | 800 | 100 | 5 |
| 22 | D | 1220 | 940 | 19 | 890 | 13 | 3 | 50 | 550 | 20 | 3 | 780 | 100 | 5 |
| 23 | D | 1220 | 940 | 19 | 890 | 13 | 3 | 50 | 550 | 50 | 0.5 | 800 | 100 | 5 |
| 24 | I | 1220 | 940 | 19 | 890 | 13 | 1 | 50 | 550 | 50 | 0.5 | 800 | 100 | 5 |
| 25 | I | 1220 | 940 | 19 | 890 | 13 | 1 | 50 | 550 | 50 | 0.5 | 800 | 100 | 5 |
| 26 | I | 1220 | 940 | 19 | 890 | 13 | 1 | 50 | 550 | 50 | 0.5 | 880 | 100 | 30 |
| 27 | I | 1220 | 940 | 19 | 890 | 13 | 1 | 50 | 550 | 50 | 0.5 | 800 | 900 | 5 |
| 28 | I | 1220 | 940 | 19 | 890 | 13 | 1 | 50 | 550 | 50 | 0.5 | 800 | 100 | 5 |
| 29 | I | 1220 | 940 | 19 | 890 | 13 | 1 | 50 | 550 | 50 | 0.5 | 800 | 100 | 5 |
| 30 | I | 1220 | 940 | 19 | 890 | 13 | 1 | 50 | 550 | 50 | 0.5 | 800 | 100 | 5 |
| 31 | I | 1220 | 940 | 19 | 890 | 13 | 1 | 50 | 550 | 50 | 0.5 | 800 | 100 | 5 |

| Steel Sheet No. | Steel Code | First Annealing Process: Area Ratio of Ferrite Phase (%) | Total Area Ratio of Hard Phase (%)*3 | Depth of Si—Mn-depleted Layer (μm)*4 | Pickling Process*5: Amount of Decrease in Weight due to Pickling (g/m$^2$) | Second Annealing Process: Annealing Temperature (° C.) | Holding Time in Annealing Temperature Range (sec) | Primary Cooling Rate (° C./s)*6 | Alloying Condition | Secondary Cooling Rate (° C./s)*7 | Skin Pass Rolling Process Elongation Ratio (%) | Note |
|---|---|---|---|---|---|---|---|---|---|---|---|---|
| 13 | B | 56 | 44 | 2.1 | 0.5 | 800 ± 20 | 100 | 3 | 520° C. × 20 s | 15 | 0.3 | Galvannealed Steel Sheet |
| 14 | B | 51 | 49 | 2.1 | 0.5 | 780 ± 20 | 50 | 10 | 520° C. × 20 s | 15 | 0.3 | Galvannealed Steel Sheet |
| 15 | B | 50 | 50 | 2.2 | 0.5 | 780 ± 20 | 50 | 10 | — | 15 | 0.3 | Galvanized Steel Sheet |
| 16 | B | 56 | 44 | 2.1 | 0.01 | 800 ± 20 | 100 | 3 | 520° C. × 20 s | 15 | 0.3 | Galvannealed |

TABLE 4-continued

| | | | | | | | | | | | | |
|---|---|---|---|---|---|---|---|---|---|---|---|---|
| | | | | | | | | | | | | Steel Sheet |
| 17 | B | 56 | 44 | 2.1 | 7 | 800 ± 20 | 100 | 3 | 520° C. × 20 s | 15 | 0.3 | Galvannealed Steel Sheet |
| 18 | C | 52 | 48 | 2.8 | 0.5 | 800 ± 20 | 100 | 3 | 520° C. × 20 s | 15 | 0.3 | Galvannealed Steel Sheet |
| 19 | C | 50 | 50 | 2.2 | 0.5 | 800 ± 20 | 100 | 3 | 520° C. × 20 s | 15 | 0.3 | Galvannealed Steel Sheet |
| 20 | C | 45 | 55 | 3.4 | 0.5 | 830 ± 20 | 100 | 3 | 520° C. × 20 s | 15 | 0.3 | Galvannealed Steel Sheet |
| 21 | D | 50 | 50 | 2.5 | 0.5 | 800 ± 20 | 100 | 3 | 520° C. × 20 s | 15 | 0.3 | Galvannealed Steel Sheet |
| 22 | D | 57 | 43 | 1.5 | 0.5 | 800 ± 20 | 100 | 3 | 520° C. × 20 s | 3 | 0.3 | Galvannealed Steel Sheet |
| 23 | D | 50 | 50 | 2.5 | 0.5 | 800 ± 20 | 100 | 3 | — | 15 | 0.3 | Galvanized Steel Sheet |
| 24 | I | 24 | 76 | 3.5 | 0.5 | 800 ± 20 | 100 | 3 | 520° C. × 20 s | 15 | 0.3 | Galvannealed Steel Sheet |
| 25 | I | 23 | 77 | 3.3 | 0.5 | 820 ± 20 | 100 | 3 | — | 15 | 0.3 | Galvanized Steel Sheet |
| 26 | I | 6 | 94 | 4.2 | 0.5 | 820 ± 20 | 100 | 3 | 520° C. × 20 s | 15 | 0.3 | Galvannealed Steel Sheet |
| 27 | I | 25 | 75 | 4.1 | 0.5 | 820 ± 20 | 100 | 3 | 520° C. × 20 s | 15 | 0.3 | Galvannealed Steel Sheet |
| 28 | I | 23 | 77 | 3.4 | 0.5 | 820 ± 20 | 100 | 30 | 520° C. × 20 s | 15 | 0.3 | Galvannealed Steel Sheet |
| 29 | I | 23 | 77 | 3.3 | 0.5 | 820 ± 20 | 100 | 3 | 520° C. × 20 s | 150 | 0.3 | Galvannealed Steel Sheet |
| 30 | I | 24 | 76 | 3.3 | 0.5 | 880±20 | 600 | 3 | 520° C. × 20 s | 5 | 0.3 | Galvannealed Steel Sheet |
| 31 | I | 23 | 77 | 3.5 | 0.5 | 720±20 | 5 | 3 | 520° C. × 20 s | 5 | 0.3 | Galvannealed Steel Sheet |

*1: average cooling rate from the finishing delivery temperature to a temperature of the finishing delivery temperature - 100° C.)
*2: average cooling rate from the annealing temperature to a cooling stop temperature of 500° C. or lower
*3: the total area ratio of martensite, bainite, and retained γ
*4: depth from the surface layer of the steel sheet over which the element concentration of Si and Mn is ¾ or less of the element concentration of these chemical elements in the steel
*5: pickling performed in a 5 mass %-hydrochloric acid solution having a temperature of 60° C. for 10 seconds
*6: average cooling rate from the annealing temperature to the temperature of the galvanizing bath
*7: average cooling rate to a temperature of 150° C. or lower after a galvanizing treatment or an alloying treatment on the galvanizing layer has been performed

TABLE 5

| | | Steel Microstructure | | | | | Mechanical Properties | | | | | | | Surface Quality | | |
|---|---|---|---|---|---|---|---|---|---|---|---|---|---|---|---|---|
| | | Ferrite | | Martensite | | | | | | | | | | Surface Appearance Quality | Surface Appearance Quality | |
| Steel Sheet No. | Steel Code | Area Ratio (%) | Average Grain Diameter (μm) | Area Ratio (%) | Average Grain Diameter (μm) | Remainder* Area Ratio (%) | YP (MPa) | TS (MPa) | EI (%) | λ (%) | TS × EI (MPa · %) | TS × λ (MPa · %) | ΔTS (MPa) | after Galvanizing | after Alloying | Note |
| 13 | B | 31 | 5 | 65 | 2.5 | 4(B) | 773 | 1268 | 12.0 | 34 | 15216 | 43112 | 44 | ○ (without Coating Defect) | ○ (without variation in Alloying) | Example |
| 14 | B | 27 | 3 | 70 | 1.8 | 3(B) | 805 | 1320 | 11.5 | 35 | 15180 | 46200 | 48 | ○ (without Coating Defect) | ○ (without variation in Alloying) | Example |
| 15 | B | 26 | 3 | 71 | 1.7 | 3(B) | 812 | 1331 | 11.4 | 35 | 15173 | 46585 | 48 | ○ (without Coating Defect) | — | Example |
| 16 | B | 31 | 4 | 65 | 2.5 | 4(5) | 774 | 1269 | 12.0 | 34 | 15228 | 43146 | 44 | x (with Coating Defect) | x (with Variation in Alloying) | Comparative Example |
| 17 | B | 32 | 4 | 66 | 2.6 | 2(B) | 775 | 1270 | 11.9 | 34 | 15113 | 43180 | 43 | x (with Coating Defect) | x (with Variation in Alloying) | Comparative Example |
| 18 | C | 29 | 4 | 68 | 1.9 | 3(B) | 838 | 1299 | 11.8 | 35 | 15328 | 45465 | 45 | ○ (without Coating Defect) | ○ (without variation in Alloying) | Example |
| 19 | C | 26 | 4 | 70 | 2.3 | 4(B) | 852 | 1320 | 11.5 | 33 | 15180 | 43560 | 45 | ○ (without Coating Defect) | ○ (without variation in Alloying) | Example |
| 20 | C | 23 | 5 | 73 | 3.2 | 4(B) | 872 | 1352 | 11.6 | 32 | 15683 | 43264 | 46 | ○ (without Coating Defect) | ○ (without variation in Alloying) | Example |
| 21 | D | 37 | 4 | 57 | 2.3 | 6(B, γ) | 789 | 1195 | 12.6 | 36 | 15057 | 43020 | 42 | ○ (without Coating Defect) | ○ (without variation in Alloying) | Example |
| 22 | D | 49 | 7 | 36 | 3.8 | 15(B, P) | 636 | 963 | 15.8 | 45 | 15215 | 43335 | 55 | x (with Coating Defect) | x (with Variation in Alloying) | Comparative Example |
| 23 | D | 36 | 4 | 57 | 2.2 | 7(B, γ) | 782 | 1183 | 12.8 | 37 | 15142 | 43771 | 45 | ○ (without Coating Defect) | — | Example |
| 24 | I | 15 | 5 | 80 | 2.9 | 5(B,γ) | 1040 | 1425 | 10.8 | 31 | 15390 | 44175 | 48 | ○ (without Coating Defect) | ○ (without variation in Alloying) | Example |
| 25 | I | 16 | 5 | 82 | 2.9 | 2(B, γ) | 1056 | 1446 | 10.7 | 30 | 15472 | 43380 | 48 | ○ (without Coating Defect) | — | Example |
| 26 | I | 14 | 6 | 81 | 5.3 | 5(B, γ) | 1055 | 1434 | 10.5 | 30 | 15057 | 43020 | 60 | ○ (without Coating Defect) | ○ (without variation in Alloying) | Comparative Example |
| 27 | I | 15 | 5 | 80 | 3.0 | 5(B, γ) | 1007 | 1392 | 10.9 | 20 | 15173 | 27840 | 46 | ○ (without Coating Defect) | ○ (without variation in Alloying) | Comparative Example |
| 28 | I | 9 | 5 | 84 | 3.1 | 7(B, γ) | 1125 | 1516 | 8.1 | 25 | 12280 | 37900 | 41 | ○ (without Coating Defect) | ○ (without variation in Alloying) | Comparative Example |
| 29 | I | 15 | 5 | 81 | 2.9 | 4(B,γ) | 1163 | 1593 | 6.5 | 15 | 5098 | 17523 | 45 | ○ (without Coating Defect) | ○ (without variation in Alloying) | Comparative Example |
| 30 | I | 19 | 5 | 79 | 5.3 | 2(B, γ) | 1033 | 1415 | 9.8 | 26 | 13867 | 36790 | 46 | x (with Coating Defect) | x (with Variation in Alloying) | Comparative Example |
| 31 | I | 73 | 5 | 25 | 3.3 | 2(B,γ) | 619 | 847 | 18.2 | 51 | 15415 | 43197 | 39 | ○ (without Coating Defect) | ○ (without variation in Alloying) | Comparative Example |

*P: pearlite, B: bainite, and γ: retained austenite (retained γ)

INDUSTRIAL APPLICABILITY

The high-strength galvanized steel sheet according to aspects of the present invention, which has not only a high tensile strength but also excellent surface appearance quality and mechanical properties having small annealing-temperature dependency, is capable of significantly contributing to the improvement of the safety of automobiles at the time of a crash and the weight reduction of automobiles, and an improvement in usability in a press forming process is also anticipated. In addition, the steel sheet can preferably be used as a raw material not only for automobile parts but also for the industrial fields of construction and home electric appliances.

The invention claimed is:

1. A method for manufacturing a high-strength galvanized steel sheet, the method comprising performing hot rolling on a steel slab having a chemical composition containing, by mass %, C:0.120% or more and 0.180% or less, Si:0.01% or more and 1.00% or less, Mn:2.20% or more and 3.50% or less, P:0.001% or more and 0.050% or less, S:0.010% or less, sol.Al:0.005% or more and 0.100% or less, N:0.0001% or more and 0.0060% or less, Nb:0.010% or more and 0.100% or less, Ti:0.010% or more and 0.100% or less, and the balance being Fe and inevitable impurities in order to obtain a hot-rolled steel sheet, performing cold rolling on the hot-rolled steel sheet in order to obtain a cold-rolled steel sheet, then performing first annealing on the cold-rolled steel sheet, performing pickling on the annealed steel sheet, and then performing second annealing on the pickled steel sheet in order to obtain a galvanized steel sheet, wherein the first annealing includes performing heating to an annealing temperature of 780° C. or higher and 850° C. or lower at an average heating rate of 1° C./s or less in a temperature range from 700° C. to the annealing temperature, holding the heated steel sheet at an annealing temperature of 780° C. or higher and 850° C. or lower for 10 seconds or more and 500 seconds or less, and cooling the held steel sheet from the annealing temperature to a cooling stop temperature of 500° C. or lower at an average cooling rate of 5° C./s or more in order to obtain a steel sheet having a steel intermediate microstructure including ferrite in an amount of 10% or more and 60% or less in terms of area ratio, and martensite, bainite, and retained austenite in a total amount of 40% or more and 90% or less in terms of area ratio, wherein the pickling is performed so that the amount of decrease in the weight of the steel sheet due to pickling is 0.05 g/m$^2$ or more and 5 g/m$^2$ or less in terms of Fe, and wherein the second annealing includes heating the pickled steel sheet to an annealing temperature of 750° C. or higher and 850° C. or lower, holding the heated steel sheet at an annealing temperature of 750° C. or higher and 850° C. or lower for 10 seconds or more and 500 seconds or less, cooling the held steel sheet from the annealing temperature at an average cooling rate of 1° C./s or more and 15° C./s or less, performing a galvanizing treatment including dipping the steel sheet in a galvanizing bath, cooling the galvanized steel sheet to a temperature of 150° C. or lower at an average cooling rate of 5° C./s or more and 100° C./s or less in order to obtain a steel sheet having a steel microstructure including, in terms of area ratio, 10% or more and 60% or less of ferrite and, in terms of area ratio, 40% or more and 90% or less of martensite.

2. The method for manufacturing a high-strength galvanized steel sheet according to claim 1, wherein an alloying treatment is further performed on the galvanized steel sheet before cooling is performed at an average cooling rate of 5° C./s or more and 100° C./s or less.

3. The method for manufacturing a high-strength galvanized steel sheet according to claim 1, wherein the steel slab has the chemical composition further containing, by mass %, one or more selected from among Mo:0.05% or more and 1.00% or less, V:0.02% or more and 0.50% or less, Cr:0.05% or more and 1.00% or less, and B:0.0001% or more and 0.0030% or less.

4. The method for manufacturing a high-strength galvanized steel sheet according to claim 1, wherein the hot rolling includes starting cooling within 3 seconds after hot finish rolling has been performed, cooling the hot-rolled steel sheet at an average cooling rate of 5° C./s or more and 200° C./s or less in a temperature range from the finishing delivery temperature of the hot rolling to a temperature of (the finishing delivery temperature of the hot rolling-100° C.), coiling the cooled steel sheet at a coiling temperature of 450° C. or higher and 650° C. or lower, and wherein the cold rolling is performed with a rolling reduction of 40% or more.

5. A method for manufacturing a high-strength galvanized steel sheet, the method comprising performing first annealing on the cold-rolled steel sheet which is hot-rolled and cold-rolled and having a chemical composition containing, by mass %, C: 0.120% or more and 0.180% or less, Si:0.01% or more and 1.00% or less, Mn:2.20% or more and 3.50% or less, P:0.001% or more and 0.050% or less, S:0.010% or less, sol.Al: 0.005% or more and 0.100% or less, N:0.0001% or more and 0.0060% or less, Nb:0.010% or more and 0.100% or less, Ti:0.010% or more and 0.100% or less, and the balance being Fe and inevitable impurities, performing pickling on the annealed steel sheet, and then performing second annealing on the pickled steel sheet in order to obtain a galvanized steel sheet, wherein the first annealing includes performing heating to an annealing temperature of 780° C. or higher and 850° C. or lower at an average heating rate of 1° C./s or less in a temperature range from 700° C. to the annealing temperature, holding the heated steel sheet at an annealing temperature of 780° C. or higher and 850° C. or lower for 10 seconds or more and 500 seconds or less, and cooling the held steel sheet from the annealing temperature to a cooling stop temperature of 500° C. or lower at an average cooling rate of 5° C./s or more in order to obtain a steel sheet having a steel intermediate microstructure including ferrite in an amount of 10% or more and 60% or less in terms of area ratio, and martensite, bainite, and retained austenite in a total amount of 40% or more and 90% or less in terms of area ratio, wherein the pickling is performed so that the amount of decrease in the weight of the steel sheet due to pickling is 0.05 g/m$^2$ or more and 5 g/m$^2$ or less in terms of Fe, and wherein the second annealing includes heating the pickled steel sheet to an annealing temperature of 750° C. or higher and 850° C. or lower, holding the heated steel sheet at an annealing temperature of 750° C. or higher and 850° C. or lower for 10 seconds or more and 500 seconds or less, cooling the held steel sheet from the annealing temperature at an average cooling rate of 1° C./s or more and 15° C./s or less, performing a galvanizing treatment including dipping the steel sheet in a galvanizing bath, cooling the galvanized steel sheet to a temperature of 150° C. or lower at an average cooling rate of 5° C./s or more and 100° C./s or less in order to obtain a steel sheet having a steel microstructure including, in terms of area ratio, 10% or more and 60% or less of ferrite and, in terms of area ratio, 40% or more and 90% or less of martensite.

6. The method for manufacturing a high-strength galvanized steel sheet according to claim 5, wherein an alloying treatment is further performed on the galvanized steel sheet before cooling is performed at an average cooling rate of 5° C./s or more and 100° C./s or less.

7. The method for manufacturing a high-strength galvanized steel sheet according to claim 5, wherein the cold-rolled steel sheet has the chemical composition further containing, by mass %, one or more selected from among Mo:0.05% or more and 1.00% or less, V:0.02% or more and 0.50% or less, Cr:0.05% or more and 1.00% or less, and B:0.0001% or more and 0.0030% or less.

8. The method for manufacturing a high-strength galvanized steel sheet according to claim 2, wherein the steel slab has the chemical composition further containing, by mass %, one or more selected from among Mo:0.05% or more and 1.00% or less, V:0.02% or more and 0.50% or less, Cr:0.05% or more and 1.00% or less, and B:0.0001% or more and 0.0030% or less.

9. The method for manufacturing a high-strength galvanized steel sheet according to claim 2, wherein the hot rolling includes starting cooling within 3 seconds after hot finish rolling has been performed, cooling the hot-rolled steel sheet at an average cooling rate of 5° C./s or more and 200° C./s or less in a temperature range from the finishing delivery temperature of the hot rolling to a temperature of (the finishing delivery temperature of the hot rolling-100° C.), coiling the cooled steel sheet at a coiling temperature of 450° C. or higher and 650° C. or lower, and wherein the cold rolling is performed with a rolling reduction of 40% or more.

10. The method for manufacturing a high-strength galvanized steel sheet according to claim 3, wherein the hot rolling includes starting cooling within 3 seconds after hot finish rolling has been performed, cooling the hot-rolled steel sheet at an average cooling rate of 5° C./s or more and 200° C./s or less in a temperature range from the finishing delivery temperature of the hot rolling to a temperature of (the finishing delivery temperature of the hot rolling-100° C.), coiling the cooled steel sheet at a coiling temperature of 450° C. or higher and 650° C. or lower, and wherein the cold rolling is performed with a rolling reduction of 40% or more.

11. The method for manufacturing a high-strength galvanized steel sheet according to claim 8, wherein the hot rolling includes starting cooling within 3 seconds after hot finish rolling has been performed, cooling the hot-rolled steel sheet at an average cooling rate of 5° C./s or more and 200° C./s or less in a temperature range from the finishing delivery temperature of the hot rolling to a temperature of (the finishing delivery temperature of the hot rolling-100° C.), coiling the cooled steel sheet at a coiling temperature of 450° C. or higher and 650° C. or lower, and wherein the cold rolling is performed with a rolling reduction of 40% or more.

12. The method for manufacturing a high-strength galvanized steel sheet according to claim 6, wherein the cold-rolled steel sheet has the chemical composition further containing, by mass %, one or more selected from among Mo:0.05% or more and 1.00% or less, V:0.02% or more and 0.50% or less, Cr:0.05% or more and 1.00% or less, and B:0.0001% or more and 0.0030% or less.

* * * * *